US006230672B1

(12) United States Patent
Ishibashi et al.

(10) Patent No.: US 6,230,672 B1
(45) **Date of Patent: *May 15, 2001**

(54) TWO-CYCLE INTERNAL COMBUSTION ENGINE

(75) Inventors: Yoichi Ishibashi; Kenji Nishida; Shinichi Isomura; Masahiro Asai; Hideki Noritake; Masami Takubo, all of Saitama (JP)

(73) Assignee: Honda Giken Kogyo Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/866,299

(22) Filed: May 30, 1997

(30) Foreign Application Priority Data

Sep. 19, 1996 (JP) ..... 8-269366

(51) Int. Cl.[7] ..... F02B 25/20; F02B 25/14; F02B 33/04; F02B 33/44

(52) U.S. Cl. ..... 123/65 P

(58) Field of Search ..... 123/65 R, 65 P, 123/80 BA, 73 R

(56) References Cited

U.S. PATENT DOCUMENTS

| | | | |
|---|---|---|---|
| 3,190,271 | 6/1965 | Gudmundsen . | |
| 3,921,608 | 11/1975 | Kottmann . | |
| 4,516,540 * | 5/1985 | Nerstrom | 123/65 P |
| 4,625,688 | 12/1986 | Takayasu . | |
| 5,205,245 * | 4/1993 | Flack et al. | 123/65 P |
| 5,503,119 | 4/1996 | Glover . | |

FOREIGN PATENT DOCUMENTS

| | | |
|---|---|---|
| 3905903 | 8/1990 | (DE) . |
| 773356 A2 | 5/1997 | (EP) . |
| 3-100318 | 4/1991 | (JP) . |
| 5-302521 | 11/1993 | (JP) . |
| WO9102144 | 2/1991 | (WO) . |

OTHER PUBLICATIONS

Japanese patent application (Abstract Only) JP–A–5–302521, Nov. 16, 1993.

Japanese patent application (Abstract Only) JP–A–3–100318, Apr. 25, 1991.

* cited by examiner

*Primary Examiner*—Marguerite McMahon
(74) *Attorney, Agent, or Firm*—Birch, Stewart, Kolasch & Birch, LLP

(57) ABSTRACT

To provide a two-cycle internal combustion engine capable of preventing the blow-by phenomenon to improve fuel economy and attain a high exhaust gas purifying performance, and increasing the responsiveness of fuel injection volume. In a two-cycle internal combustion engine, a chamber is disposed in scavenging passages for communicating a crank chamber to a combustion chamber, sealable control valves are respectively disposed in an inlet and an outlet of the chamber, and a fuel feeding system for the supply of fuel into the chamber is provided. The chamber is communicated to one scavenging passage out of a plurality of parallel scavenging passages. The combustion chamber side control valve disposed at an outlet of the chamber on the downstream side of the crank case side control valve provided at an inlet of the chamber, is positioned at the bottom portion of a scavenging passage communicated to the chamber.

30 Claims, 27 Drawing Sheets

TWO-CYCLE INTERNAL COMBUSTION ENGINE

BACKGROUND OF THE INVENTION

1. Field of the Invention

The present invention relates to a two-cycle internal combustion engine capable of preventing a blow-by phenomenon of a mixture in a combustion chamber thereby improving fuel economy and attaining better exhaust gas purifying performance.

2. Description of Background Art

In a related art, fuel supplied by a carburetor to a two-cycle internal combustion engine is mixed with intake air and the resulting mixture is sucked into a crank chamber and is then supplied into a combustion chamber through a scavenging port. In this case, since the timing of the opening an exhaust port is set earlier than that of the scavenging port (an upper edge of the exhaust port is higher than that of the scavenging port), the mixture fed into the combustion chamber is discharged into an exhaust passage, thus easily causing a so-called blow-by phenomenon.

Although the blow-by phenomenon is suppressed by an exhaust pulsating effect in an exhaust chamber, it is difficult for the suppression to cover the whole operation range, resulting in that both the fuel economy and exhaust purifying performance are affected.

In an effort to solve the above-mentioned problem, two-cycle internal combustion engines have been proposed in Japanese Patent Laid-open Nos. Hei 3-100318 and Hei 5-302521.

In the two-cycle internal combustion engine disclosed in Japanese Patent Laid-open No. Hei 3-100318, a high pressure chamber is connected to a crank chamber through a check valve, the high pressure chamber is connected to the combustion chamber through an air passage, a solenoid valve is disposed in the lower end of the air passage, and a fuel injection valve capable of injecting fuel towards the combustion chamber is provided at the upper end of the air passage.

In the two-cycle internal combustion engine disclosed in Japanese Patent Laid-open No. Hei 5-302521, a chamber is formed in a position adjacent to both the crankcase and the cylinder block, an intake control valve is interposed between a crank chamber and said chamber, a scavenging control valve is interposed between said chamber and a combustion chamber in a cylinder, and a fuel injection valve is provided for injection of fuel toward said chamber.

In the two-cycle internal combustion engine described in Japanese Patent Laid-open No. Hei 3-100318, with respect to the fuel injected from the fuel injection valve, part of the fuel deposited in the air passage falls by gravity, entering the crank chamber through a check valve disposed at the bottom of the air passage, and flows in a state wherein the fuel is atomized into the combustion chamber from the crank chamber through another scavenging port. As a result, it is difficult to sufficiently prevent the blow-by phenomenon and to obtain a stable combustion. Further, it is difficult to suitably control the amount of fuel fed into the combustion chamber, resulting in degraded responsiveness.

In the two-cycle internal combustion engine described in Japanese Patent Laid-open No. Hei 5-302521, all of the intake air in the crank chamber is introduced through the intake control valve and is mixed with the fuel introduced into the chamber through the fuel injection valve. The resulting mixture flows into the combustion chamber through the scavenging control valve. Accordingly, the two-cycle internal combustion engine is not configured so as to permit only air to flow from the crank chamber into the combustion chamber through a scavenging port, and hence the blow-by phenomenon is unavoidable. Further, although an upstream side of the scavenging control valve is opened to the lower portion of said chamber, the opening position thereof is not the lowest, so that the fuel injected into said chamber remains at the bottom of said chamber, thus giving rise to a problem that the amount of fuel fed into the combustion chamber cannot be accurately proportional to the amount of fuel injected from the fuel injection valve, resulting in degraded responsiveness.

SUMMARY AND OBJECTS OF THE INVENTION

To provide an improved two-cycle internal combustion engine capable of solving the above-described problems, the present invention has been made wherein a two-cycle internal combustion engine is provided in which a control valve for operably controlling a communication passage which communicates a combustion chamber to a chamber contiguous to a fuel injection device is disposed in the communication passage and fuel is fed into said combustion chamber via said communication passage. The chamber contiguous to said fuel injection device is juxtaposed on a side of said combustion chamber and at least a control portion of said control valve is positioned lower than a communicating portion through which said communication passage is communicated to said chamber contiguous to said fuel injection device.

In the present invention, fuel is supplied into the combustion chamber through the communication passage, so that at the scavenging stroke, a burned gas in the combustion chamber can be positively discharged from the exhaust port by introducing air not mixed with fuel into the combustion chamber through the scavenging passage. As a result, it is possible to prevent blow-by of the mixture in the combustion chamber and to improve a scavenging efficiency due to air scavenging upon low load running.

Since at least the control portion of the control valve is positioned lower than the communicating portion at which the communication passage is communicated to the chamber contiguous to the fuel injection device, even if the fuel supplied from the fuel injection device into said chamber remains at a bottom portion of said chamber and/or at lower portions of both the communication passage communicated to said chamber and the control valve, the remaining fuel can be almost positively discharged into the combustion chamber. As a result, it is possible to suitably, responsively control the amount of the fuel supplied into the combustion chamber and hence to obtain a stable combustion state.

Further, since the chamber contiguous to the fuel injection device is juxtaposed on a side of the combustion chamber, the entire engine can be compactly formed into a substantially square shape in a side view, and thereby the vertical length of the entire engine can be shortened as compared with the case where said chamber is disposed over the combustion chamber. As a result, in the case of mounting the engine on a vehicle, it is possible to increase the degree of freedom in layout, and particularly, in the case of mounting the engine on a motorcycle, it is possible to eliminate an inconvenience in which the vehicular height and the minimum ground clearance become higher.

According to the present invention, the fuel supplied into the combustion chamber scavenges the remaining burned gas without occurrence of the blow-by thereof, with a result that the fuel can be positively fed into the combustion chamber.

According to the present invention, it is possible to easily control opening/closing of the control valve in synchronization with rotation of the crank shaft of the engine.

According to the present invention, a relatively small amount of air to be mixed with fuel supplied to the combustion chamber through the communication passage between the combustion chamber and the chamber contiguous to the fuel injection device can be positively sucked in said chamber, and also a pressure sufficient to feed the mixture into the combustion chamber through the communication passage can be obtained.

Further, the mixture becomes rich and the resulting rich mixture flows into the combustion chamber which has been sufficiently scavenged by the air (not mixed with fuel) passing another scavenging passage, so that it is possible to suitably adjust the concentration of the mixture in the combustion chamber and hence to obtain a desirable combustion state. This makes it possible to improve fuel economy and attain a high exhaust gas purifying performance.

In addition, at the beginning of scavenging, the valves (gate valve and control valve) at the outlet and the inlet of the chamber are closed and air not mixed with fuel is introduced from another scavenging port into the combustion chamber, to positively discharge the burned gas in the combustion chamber from the exhaust port. This is effective to prevent blow-by of the mixture introduced in the combustion chamber through the communication passage upon completion of scavenging (upon closing of the scavenging port).

According to the present invention, the filling of the chamber with air can be performed by making use of a high pressure in the combustion chamber, so that it is possible to obtain a positive, stable and high chamber pressure as compared with the filling using pressure in the crank chamber.

The mixture obtained by filling said chamber with air becomes rich, and the resulting rich mixture flows in the combustion chamber which has been sufficiently scavenged by the air (not mixed with fuel) passing through another scavenging passage, so that it is possible to suitably adjust the concentration of the mixture in the combustion chamber and hence to obtain a desirable combustion state. This makes it possible to improve fuel economy and attain a high exhaust gas purifying performance.

Since highly compressed air for forming the rich mixture is obtained from the combustion chamber, the control valve in the communication passage between the chamber and the combustion chamber can be provided in a cylinder wall near the combustion chamber. As a result, it is possible to shorten a length of a portion of the communication passage extending between the control valve and the mixture injection port, and hence to reduce the amount of a carrier gas (air) required to allow the fuel to pass through the communication passage.

In addition, the timing of the opening of the control valve must be set in consideration with respect to the time required for the fuel to pass through the communication passage and hence it must be set to be earlier for a higher rotational speed. However, according to the present invention, since the length of the portion of the communication passage between the control valve and the mixture injection port can be shortened as described above, a time required for the fuel to pass through the communication passage can be shortened and thereby an effect of the time factor on the setting of the timing of opening the control valve is reduced. As a result, it is possible to easily set the timing of the opening of the control valve, and hence to improve the suitability of the set-up timing of the opening of the control valve to rotational speeds over a wide range.

According to the present invention, it is possible to simplify the communication passage and hence to facilitate the manufacture thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
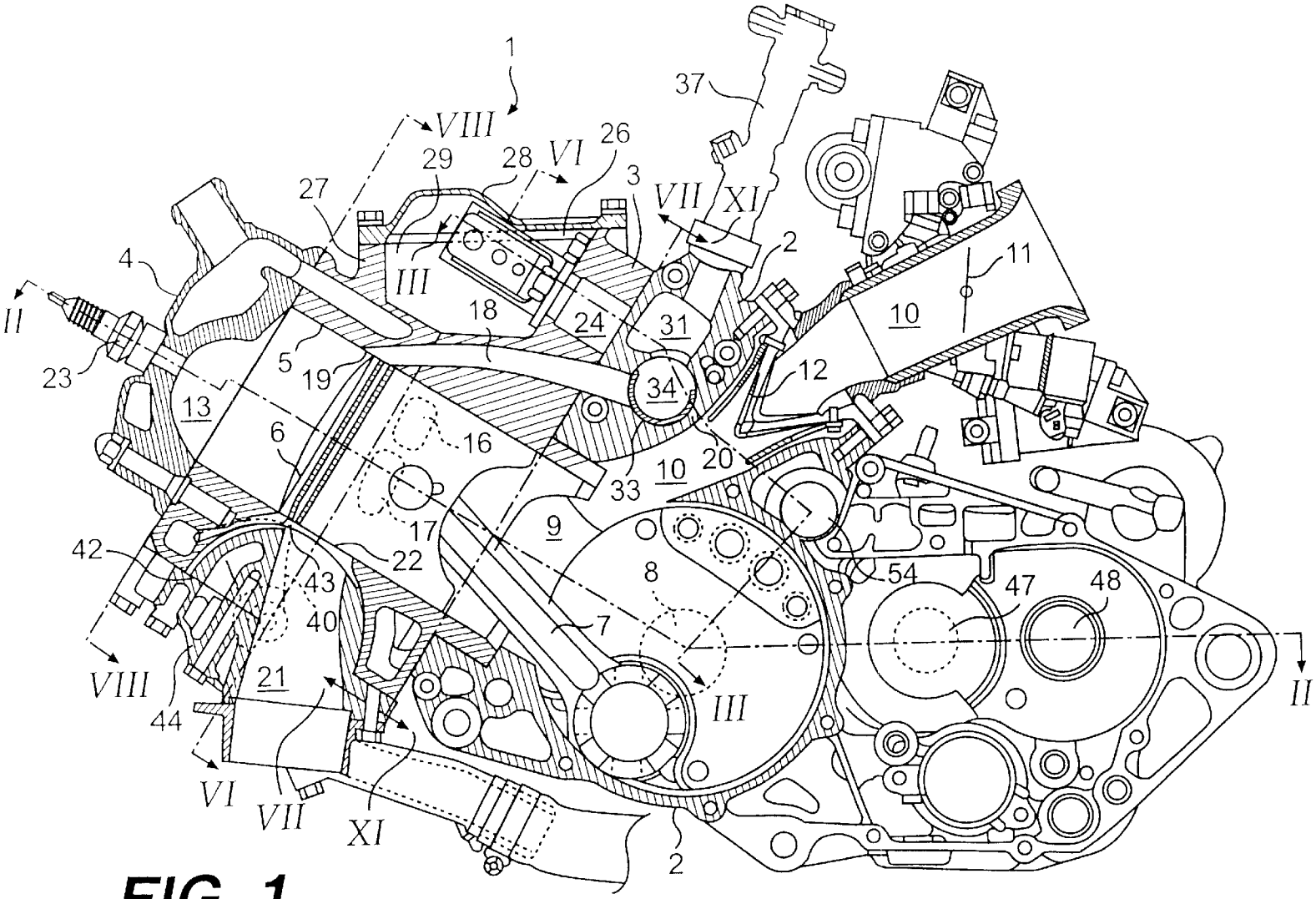
FIG. 1 illustrates a vertical sectional view of a first embodiment of the present invention.

A first embodiment of the present invention will be described with reference to FIGS. 1 to 16.

In a spark ignition type two-cycle internal combustion engine 1 of the present invention which is mounted on a motorcycle (not shown), a cylinder block 3 and a cylinder head 4 are sequentially stacked above a crank case 2 and integrally combined with each other.

A piston 6 is vertically slidably inserted into a cylinder bore 5 formed in the cylinder block 3. The piston 6 and a crank shaft 8 are connected to each other by a connecting rod 7 in such a manner that the crank shaft 8 is rotated with ascent and descent of the piston 6.

An intake passage 10 extending from the back to the front of the vehicle body is connected to the crank case 2, with a throttle valve 11 and a reed valve 12 interposed in series in the intake passage 10. The throttle valve 11 is connected to a throttle grip (not shown) through a connecting means (not shown) in such a manner that the opening of the throttle valve 11 is increased by twisting the throttle grip in one direction.

A total of four air supply scavenging passages 14 and 15, two each on the right and left sides, are provided for communicating an upper portion of the cylinder bore 5 to a crank chamber 9 are formed in the crank case 2 and the cylinder block 3. A rich mixture supply scavenging passage 18 is formed in a position closer to the rear portion of the vehicle body. A scavenging port 19 of the rich mixture supply scavenging passage 18 is located higher than scavenging ports 16 and 17 of the air supply scavenging passages 14 and 15. The rich mixture supply scavenging passage 18 extends downwardly from the scavenging port 19 towards the intake passage 10 and is opened to a valve receiving hole 20 formed in the crank case 2 in parallel with the crank shaft 8. A cylinder bore 5 side exhaust port 22, formed in an exhaust passage 21, is located opposite to the scavenging port 19.

A generally hemispherical combustion chamber 13, formed above the cylinder bore 5, is offset towards the exhaust port 22, and an ignition plug 23 is disposed in the combustion chamber 13.

An air passage 24 is formed in the cylinder block 3 at a position directly above the intake passage 10. Air introducing grooves 25 are formed in an underside of the cylinder block 3 which are brought in contact with the crank case 2. The air introducing grooves 25 extend around an outer periphery of the cylinder bore 5 to communicate the air supply scavenging passages 14 positioned closer to the intake passage 10 to the air passage 24. A reed valve 26 as a crank chamber side control valve is provided above the air passage 24, and a partition wall 27 is formed in the cylinder block 3 on a side of the combustion chamber 13 so as to surround the reed valve 26, with a cover 28 which is removably attached to an open edge of the partition wall 27. The partition wall 27 and the cover 28 constitute a chamber 29.

Air passages 30 extending in the vertical direction are formed in the cylinder block 3 on right and left sides of the air passage 24, while a mixing chamber 31 is formed in the crank case 2. The mixing chamber 31 is communicated to the air passages 30 through communication passages 32 provided at both right and left ends communicated to lower ends of the air passages 30. A rotary valve 33 as a combustion chamber side control valve is rotatably inserted in the valve receiving hole 20. The rotary valve 33 has a valve chamber 34 circumferentially opened at its longitudinal central portion and a fuel introducing passage 35 extending from the left end of the rotary valve 33 in such a manner so as to be in communication with the valve chamber 34. The rotary valve 33 is, as will be described later, rotated in the same direction as that of the crank shaft (counterclockwise in FIGS. 1 and 4).

A fuel injection valve mounting hole 36 is formed in the crank case 2 and extends from the rear portion of the vehicle body towards the mixing chamber 31. A fuel injection valve 37 is mounted in the fuel injection valve mounting hole 36; while a fuel injection valve mounting hole 38 extends from the left surface of the crank case 2 towards the fuel introducing passage 35 and communicates with the fuel introducing passage 35 formed in the crank case 2. A fuel injection valve 39 is mounted in the fuel injection valve mounting hole 38.

Figure 6:
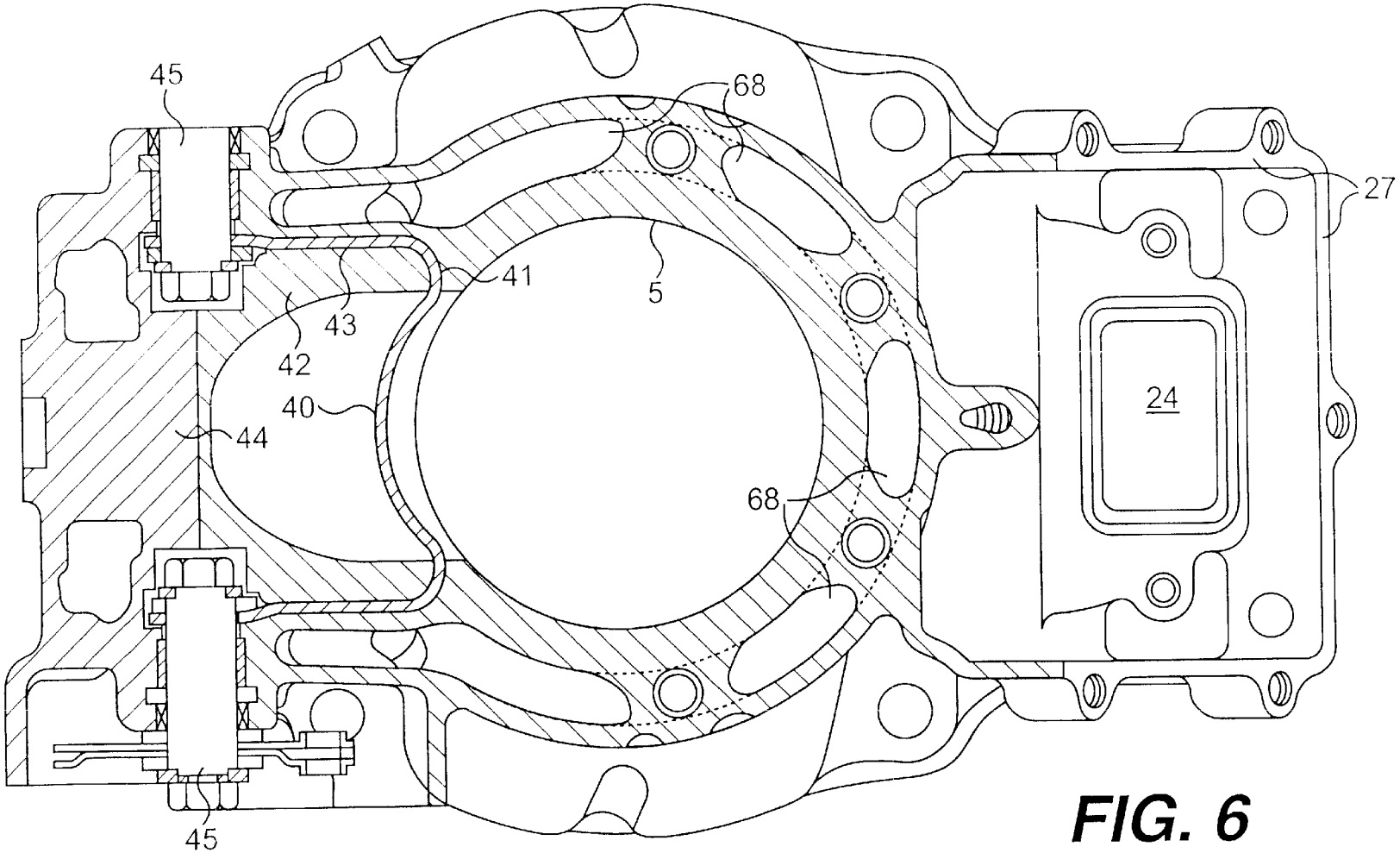
FIG. 6 is a transverse sectional plan view taken on line VI—VI in FIG. 1.
Figure 7:
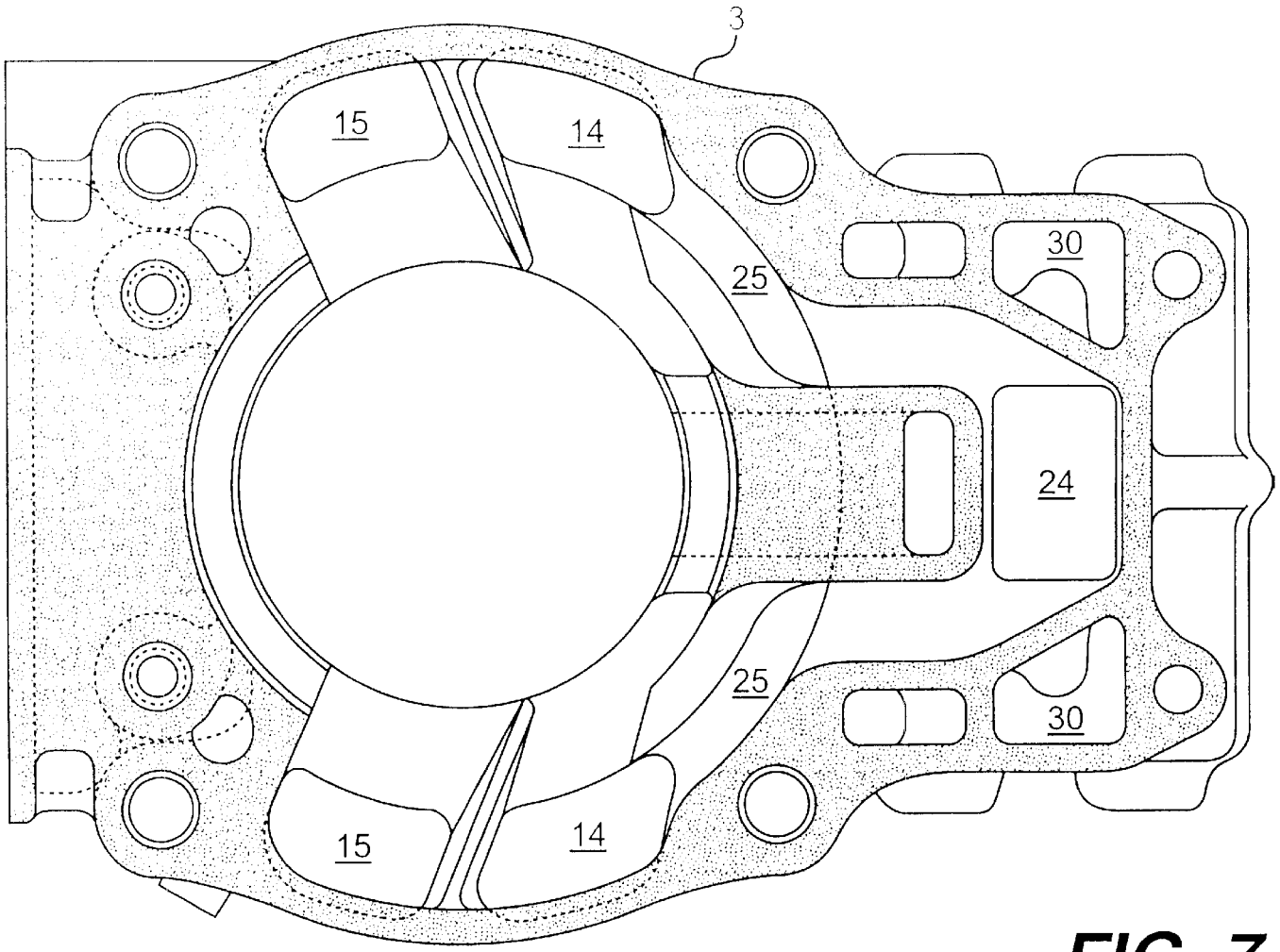
FIG. 7 is a view as seen in the direction of arrows VII—VII in FIG. 1, wherein dotted portions indicate faces of abutment with the crank case.
Figure 8:
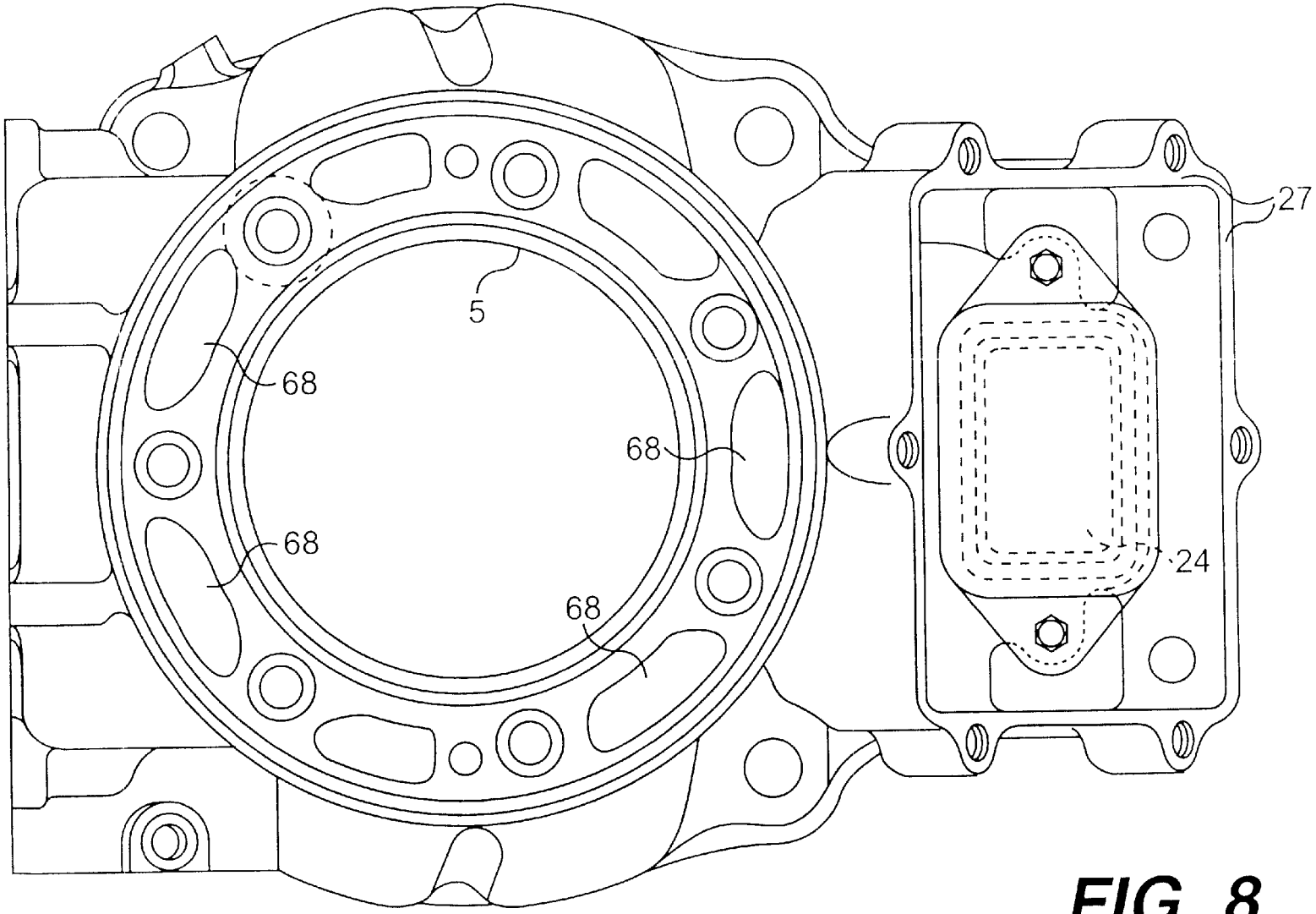
FIG. 8 is a view as seen in the direction of arrows VIII—VIII in FIG. 1.
Figure 9:
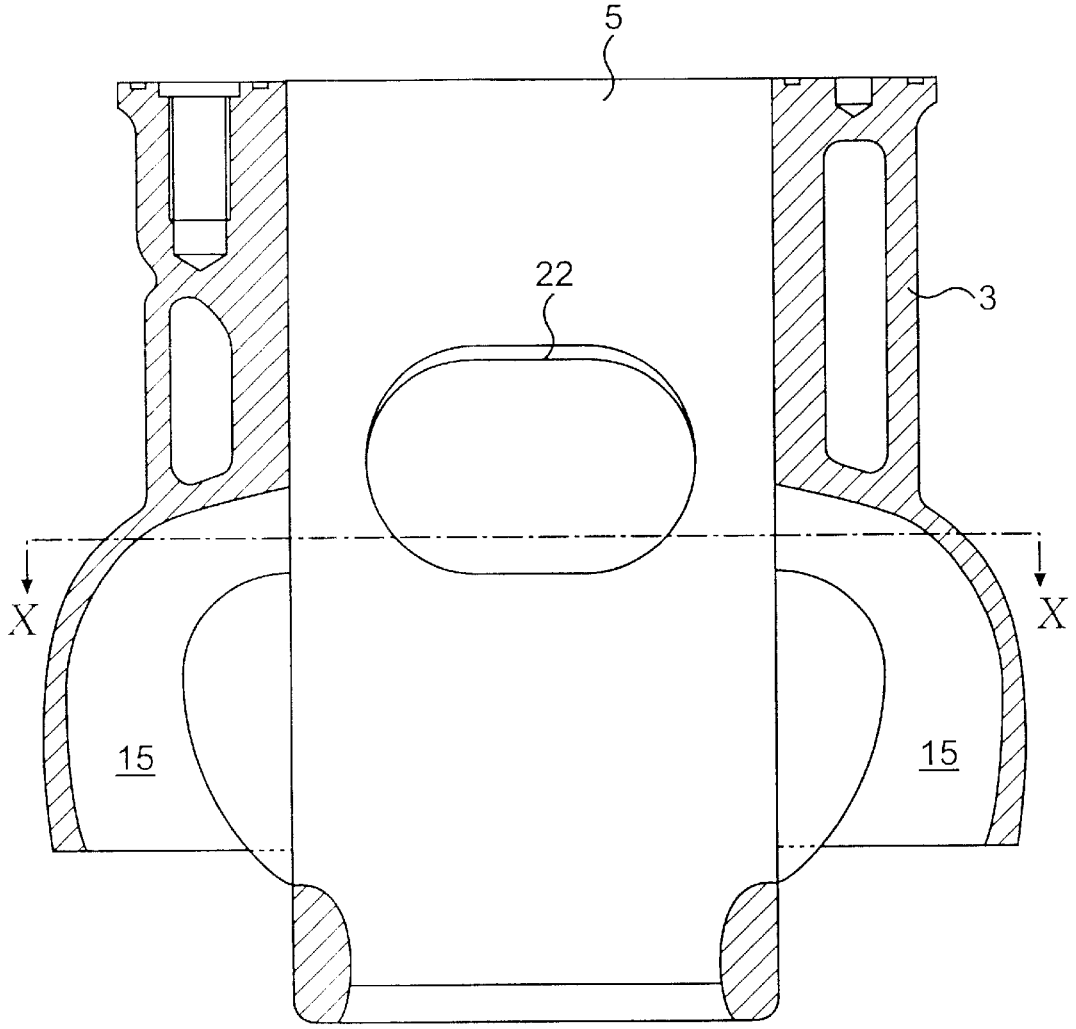
FIG. 9 is a vertical sectional front view of a cylinder block.
Figure 10:
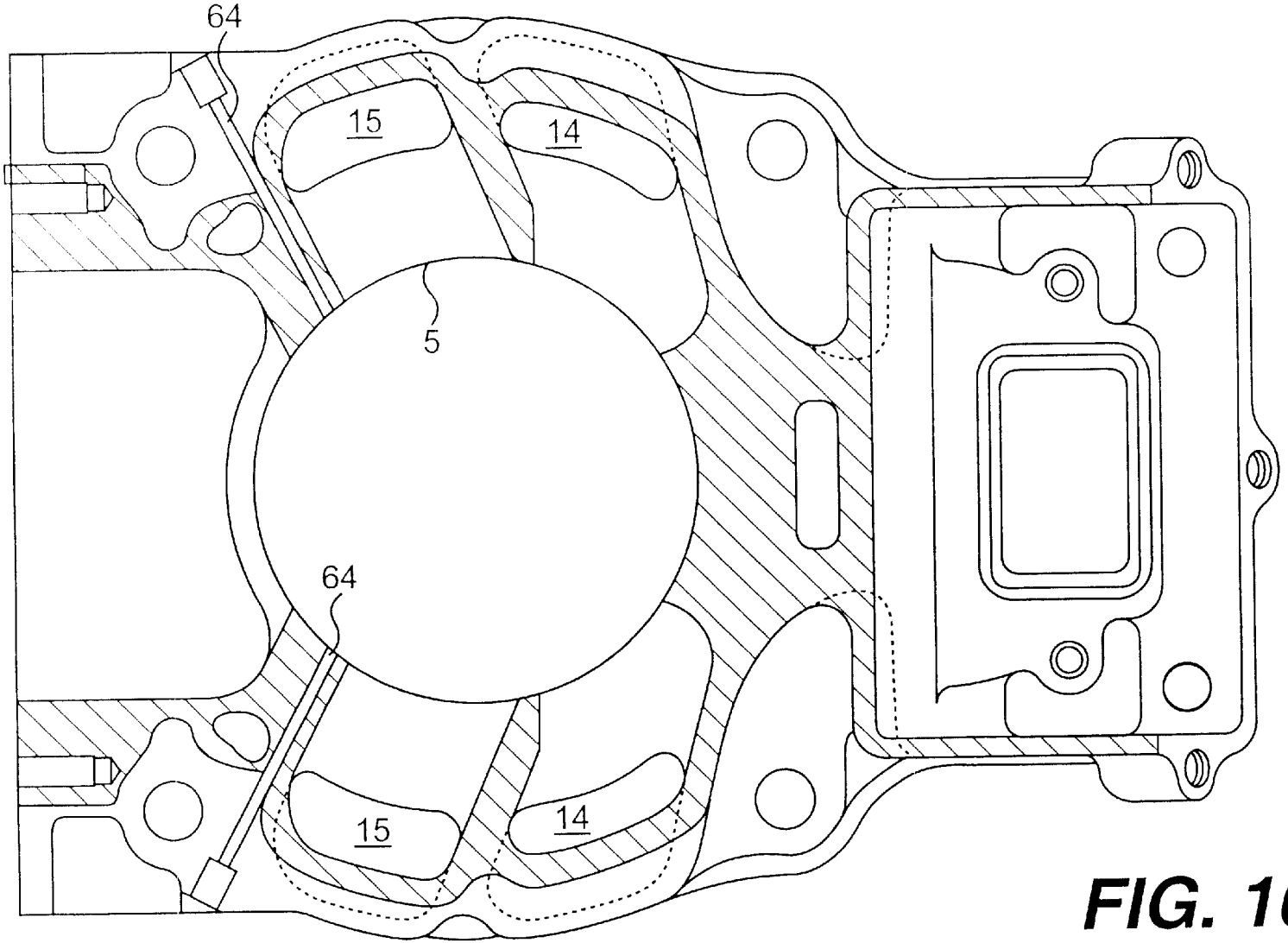
FIG. 10 is a transverse sectional plan view taken on line X—X in FIG. 9.

As shown in FIGS. 1 and 6, an exhaust control valve 40 is disposed near the exhaust port 22 of the exhaust passage 21. A gap 43 having a substantially uniform width is formed between a recess 41 formed in the cylinder block 3 into an arcuate shape in vertical cross-section and an exhaust passage member 42 is formed substantially into the same shape as that of the recess 41. The exhaust control valve 40 is fitted in the gap 43. A base portion of the exhaust control valve 40 is integrally mounted on rotating shafts 45 which are rotatably supported by both the exhaust passage member 42 and an exhaust pipe mounting member 44 integrally combined with the exhaust passage member 42. The rotating shafts 45 are connected to an exhaust control servo-motor (not shown). The exhaust control servo-motor operates in accordance with a control signal outputted from a CPU (not shown) on the basis of an exhaust opening map using the degree of opening of the throttle valve 11 and the rotational speed of the spark ignition type two-cycle internal combustion engine 1 as independent variables, whereby the exhaust control valve 40 is rocked for selecting an optimal exhaust opening matched with the operating condition.

Figure 2:
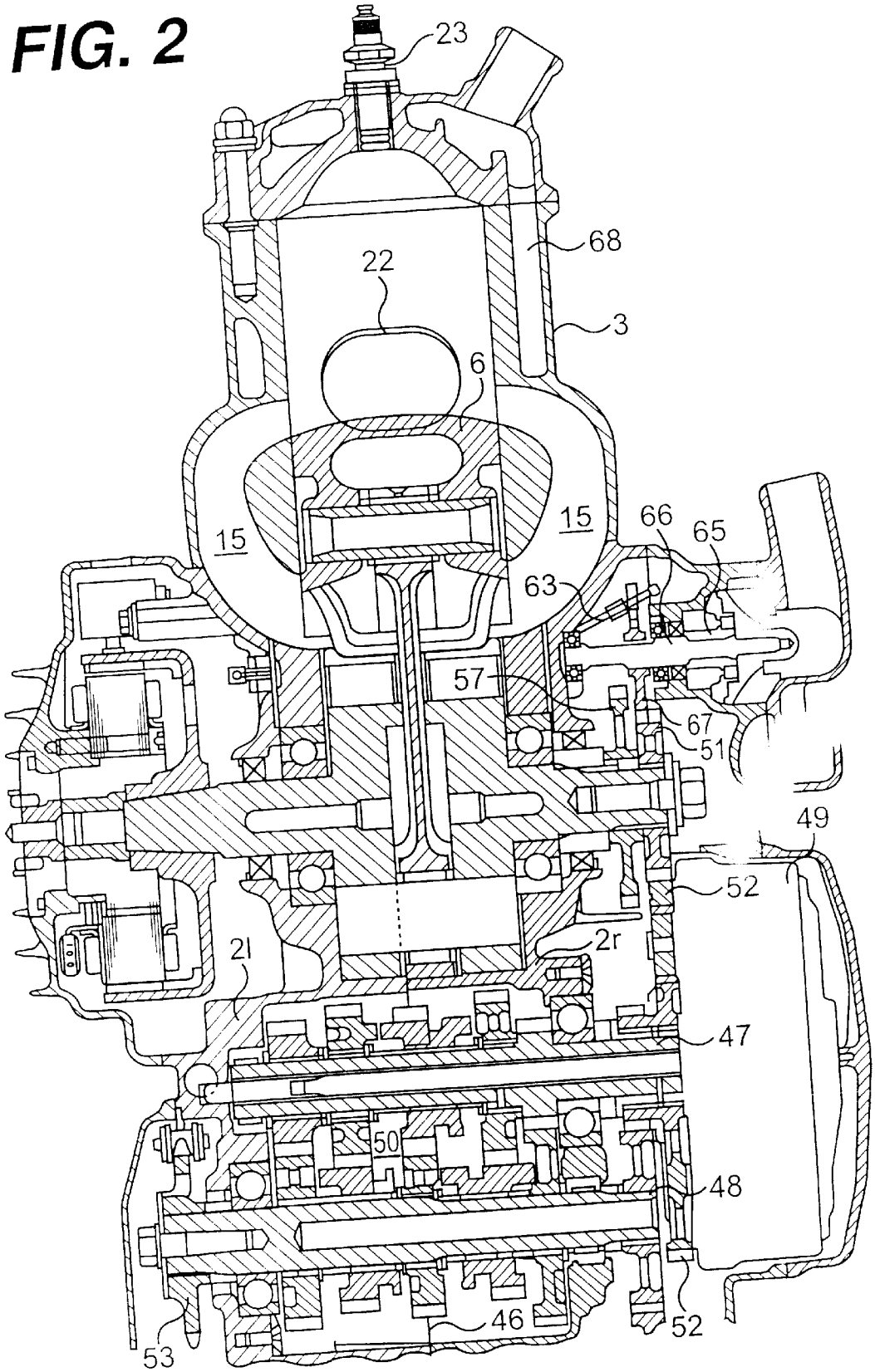
FIG. 2 illustrates a vertical sectional view taken on line II—II in FIG. 1.
Figure 3:
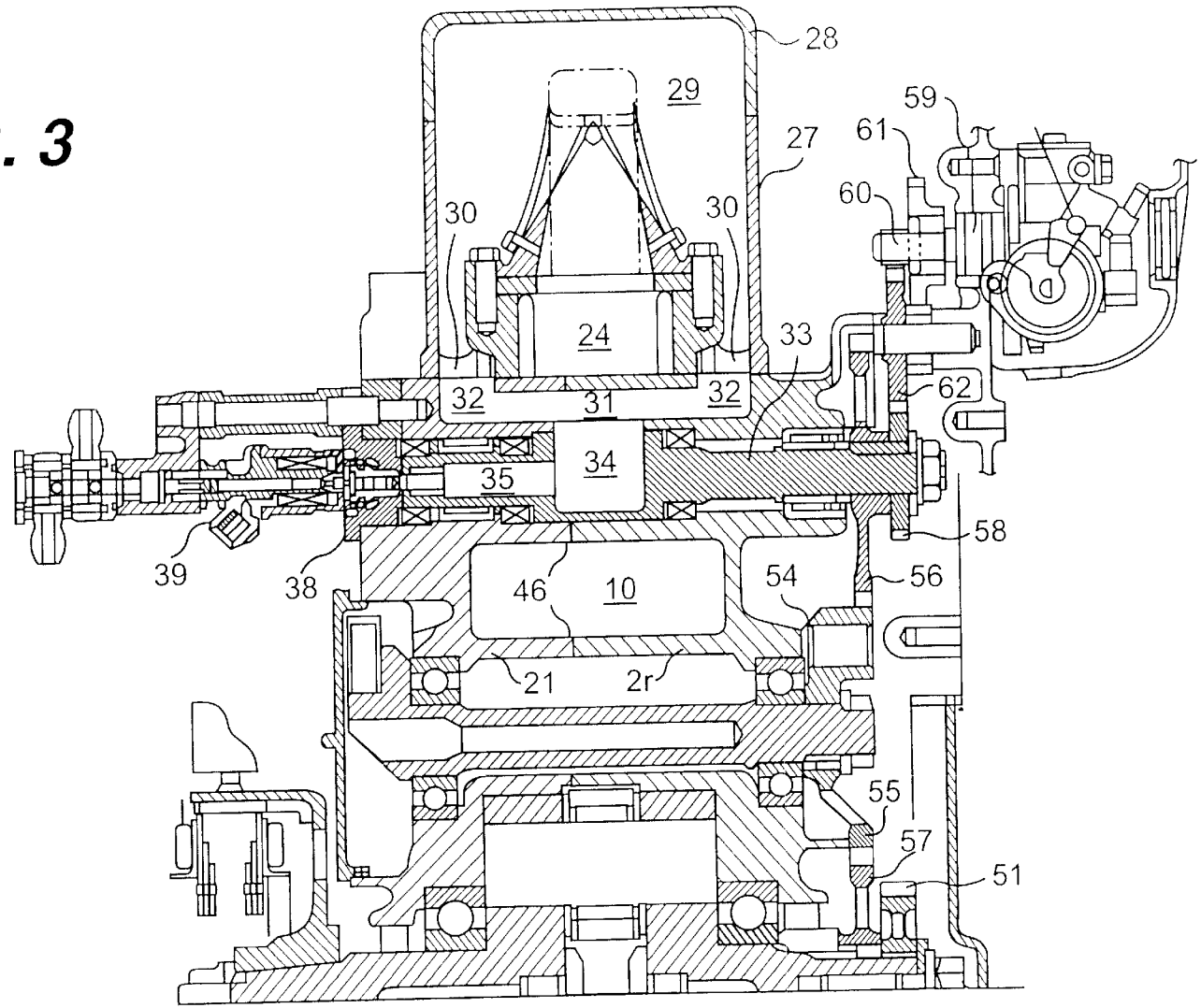
FIG. 3 illustrates a vertical sectional view taken on line III—III in FIG. 1.
Figure 4:
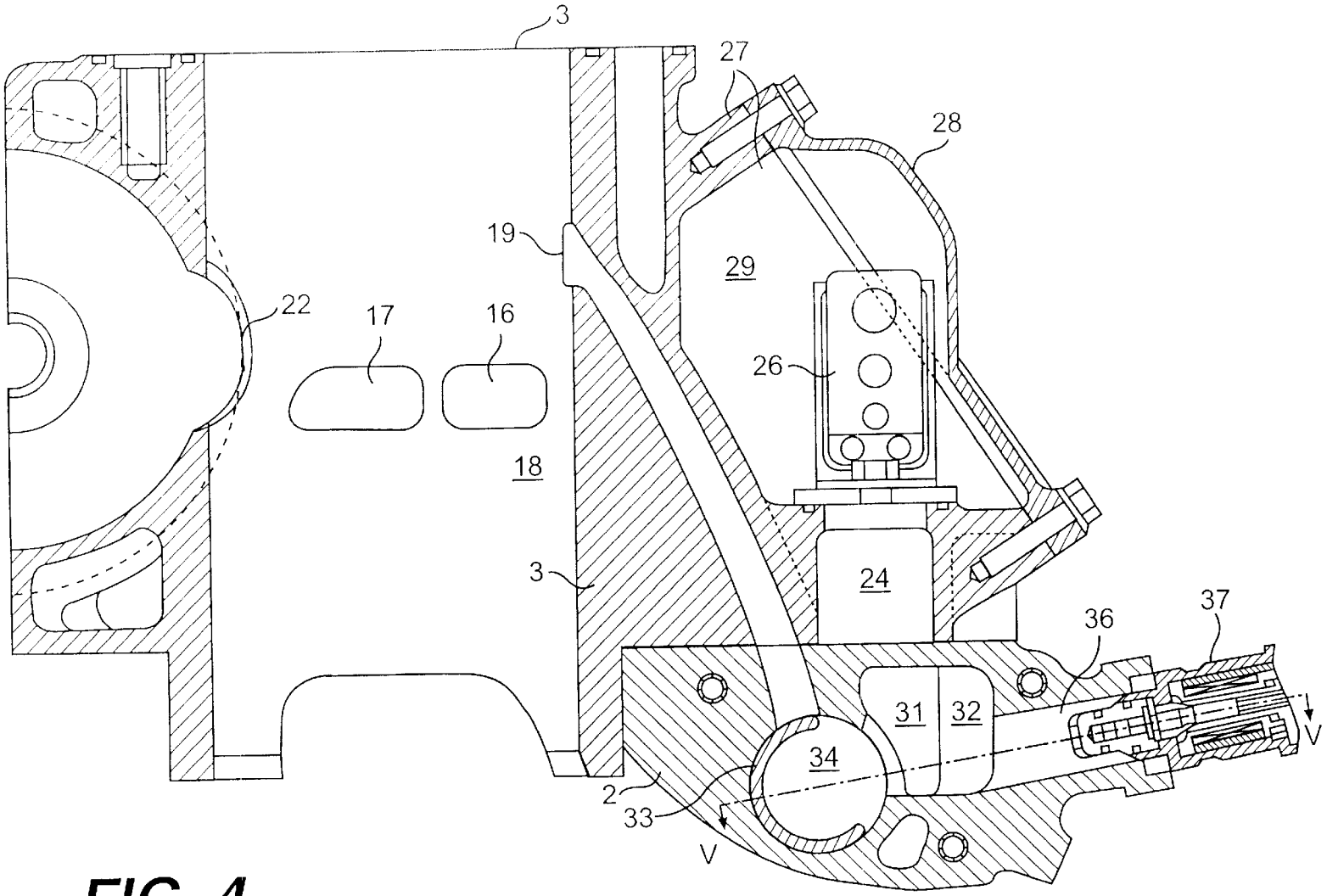
FIG. 4 is an enlarged vertical sectional side view of a principal portion of FIG. 1.
Figure 5:
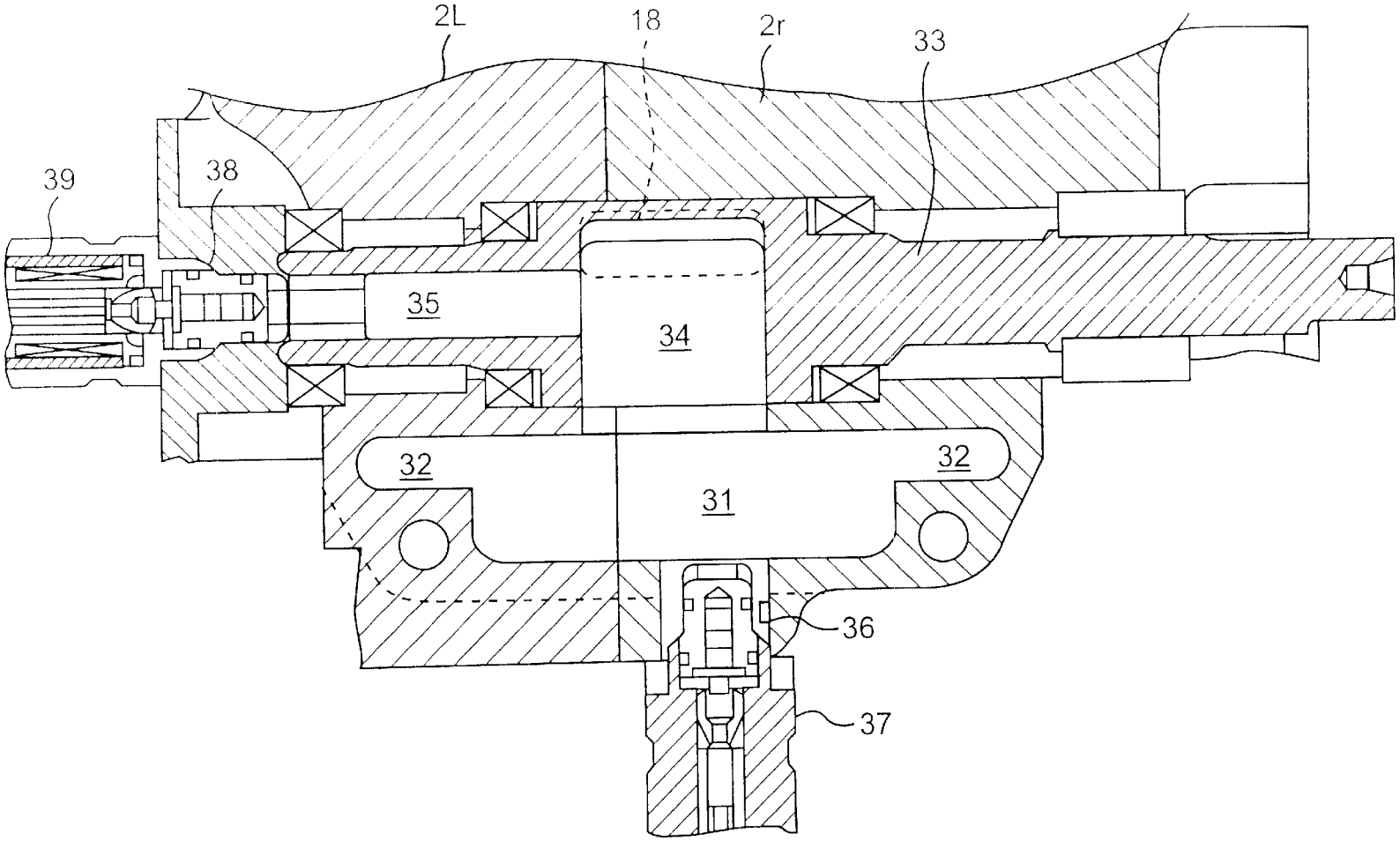
FIG. 5 is a transverse sectional plan view taken on line V—V in FIG. 4.
Figure 11:
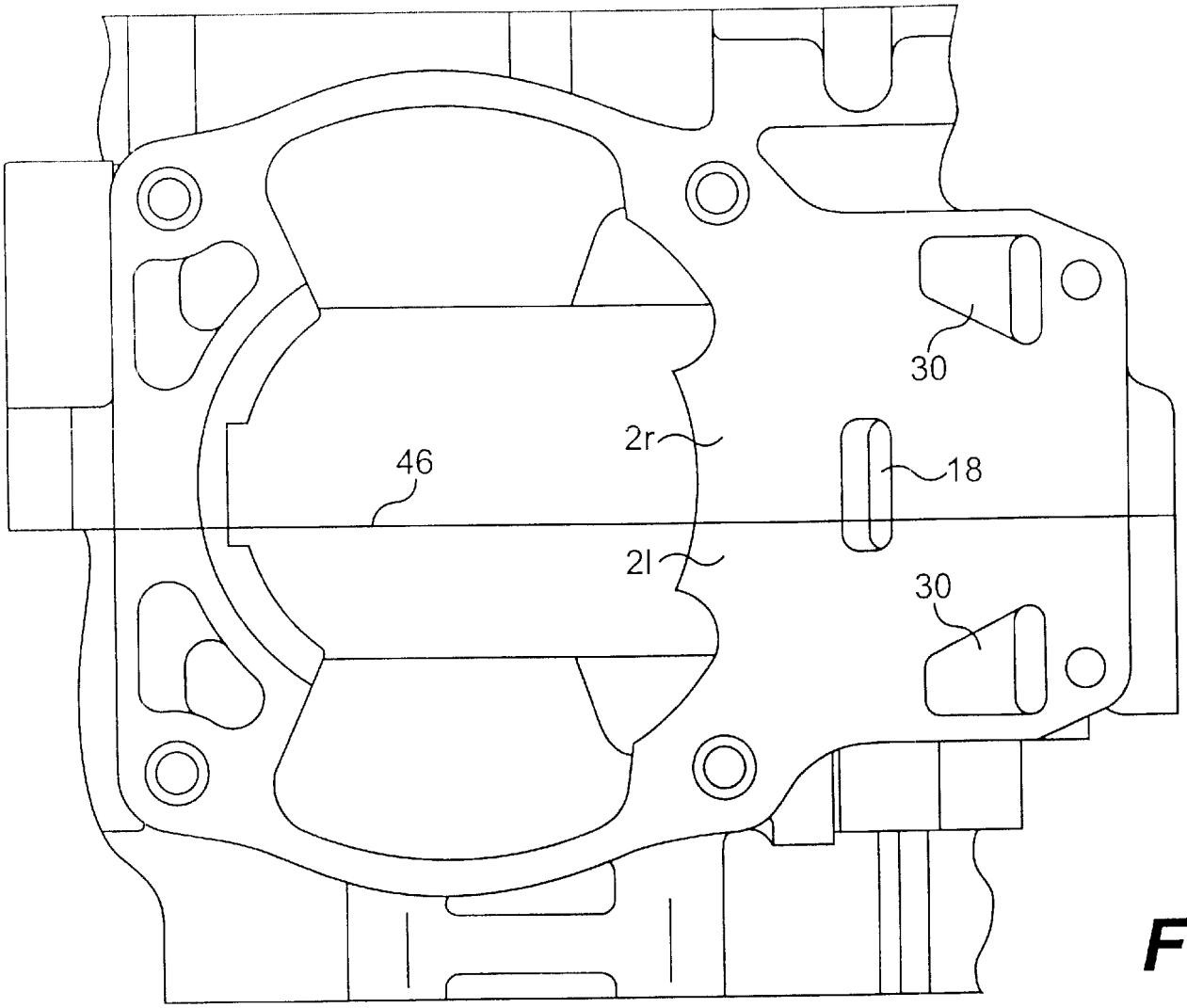
FIG. 11 is a view as seen in the direction of arrows XI—XI in FIG. 1.
Figure 12:
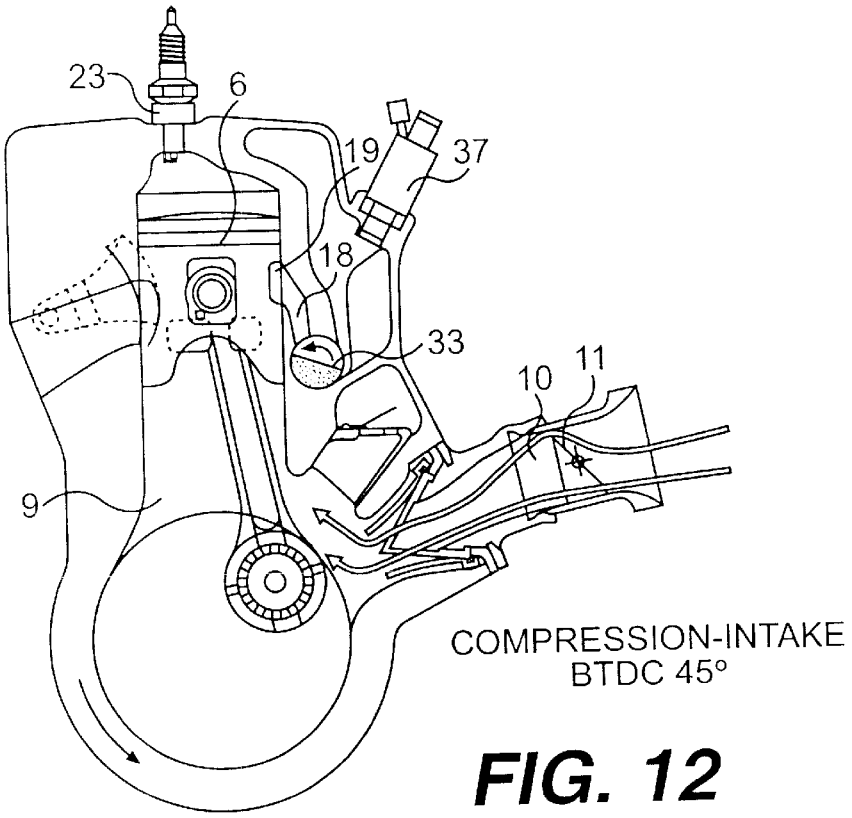
FIG. 12 illustrates a diagram showing a state of 45° before arrival at the top dead center (TDC)

As shown in FIGS. 2, 3 and 11, the crank case 2 is split into a left crank case 21 and a right crank case 2*r* with respect to split faces 46. A main shaft 47 and a counter shaft 48, positioned behind the crank shaft 8, are rotatably supported by the left crank case 21 and the right crank case 2*r*. A clutch 49 is mounted on the main shaft 47 and a train of speed change gears 50 are mounted on the main shaft 47 and counter shaft 48. A driven gear 52 of the clutch 49 meshes with a drive gear 51 mounted at the right end of the crank shaft 8. A chain sprocket 53 is integrally mounted at the left end of the counter shaft 48, and an endless chain is provided between the chain sprocket 53 and a chain sprocket mounted to a rear wheel (not shown). When the spark ignition type two-cycle internal combustion engine 1 is operated and the clutch 49 is in an engaged state, a rotating force of the crank shaft 8 is transmitted to the chain sprocket 53 through the driving gear 51, driven gear 52, clutch 49, speed change gears 50, and counter shaft 48. The rear wheel is thus rotated.

A balancer weight 54 for canceling a primary force of inertia of the crank shaft 8, which is located at an obliquely upward position behind the crank shaft 8, is rotatably supported by both the left and right crank cases 2*l*, 2*r*. A balanced gear 55 is integrally mounted at the right end (in the figure) of the balancer weight 54, and a driven gear 56 is integrally mounted on the right side of the rotary valve 33. A drive gear 57 is provided on the crank shaft 8, the balancer gear 55, and the driven gear 56, successively mesh with each other. Upon rotation of the crank shaft 8, the balancer weight 54 is rotated in the direction opposed to the crank shaft 8 and the rotary valve 33 is rotated in the same direction as that of the crank shaft, each at the same speed as the rotational speed of the crank shaft 8.

A drive gear 58 is fitted at the right end of the rotary valve 33 and a plunger type oil pump 59 is disposed adjacent to the right side of the rotary valve 33. An intermediate gear 62 meshes with both the driving gear 58 and a driven gear 61 integrated with a drive shaft 60 of the oil pump 59. The oil pump 59 is operated when the rotary valve 33 is rotated with rotation of the crank shaft 8.

Oil from the oil pump 59 is supplied to a bearing portion of the crank shaft 8 through an oil feed path 63 (see FIG. 2) and is also supplied through an oil feed path 64 (see FIG. 10) to a sliding portion between the cylinder bore 5 and the piston 6.

As shown in FIG. 2, a driven gear 67 integrated with a rotating shaft 66 of a water pump 65 meshes with the drive gear 51 mounted at the right end of the crank shaft 8. Upon start-up of the spark ignition type two-cycle internal combustion engine 1, the water pump 65 is rotated, so that cooling water in the engine 1 is fed to a radiator (not shown) for cooling and is returned again into a cooling water passage 68 in the engine 1.

In the illustrated spark ignition type two-cycle internal combustion engine 1 having the above configuration, when the crank shaft 8 is rotated counterclockwise in FIGS. 12 to 15 by means of a starter motor (not shown), the scavenging port 19 of the rich mixture supply scavenging passage 18 is closed by the piston 6 at a time point of 75° ahead of the top dead center (TDC), so that the combustion chamber 13 is compressed and the ignition plug 23 is ignited at a predetermined timing before the top dead center. Further, with the ascent of the piston 6, the crank chamber 9 continues to expand and the intake of air is continued (see FIG. 12).

Figure 13:
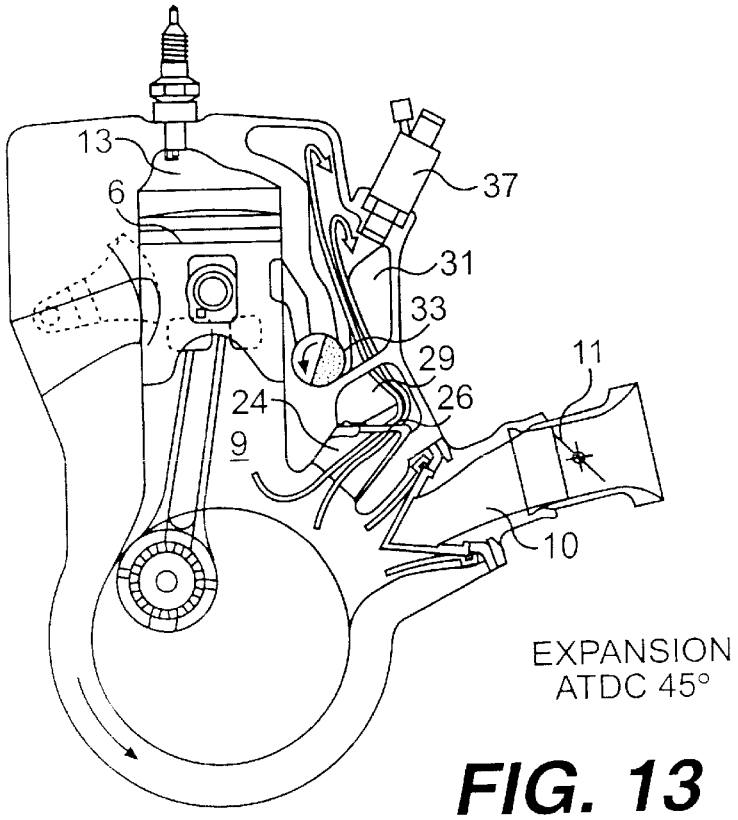
FIG. 13 is a diagram showing a state of 45° after passing the top dead center (TDC)
Figure 14:
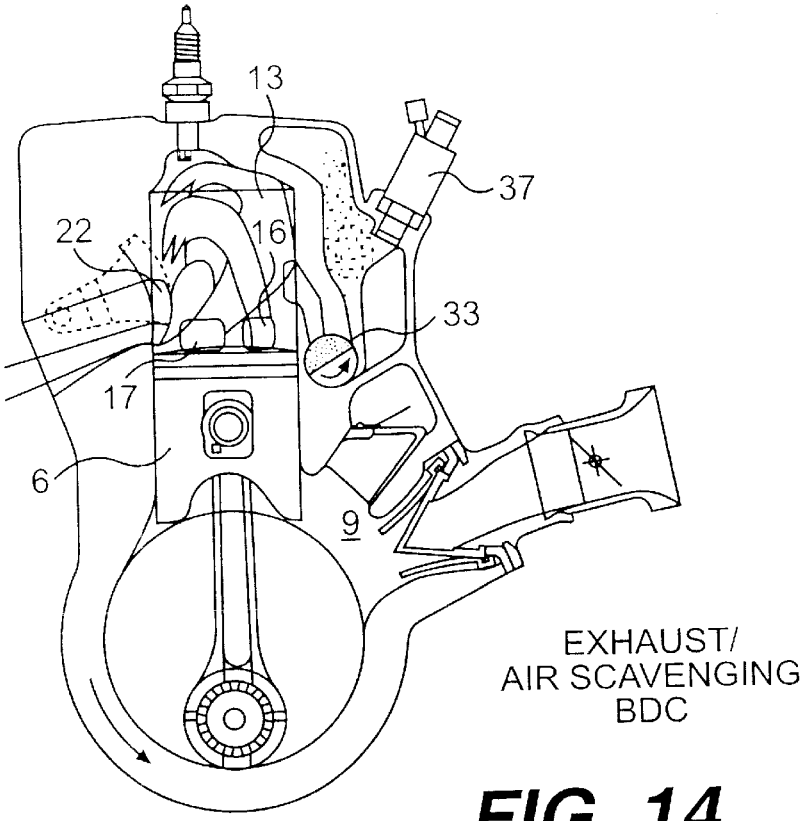
FIG. 14 is a diagram showing a state of arrival at the bottom dead center (BDC)
Figure 15:
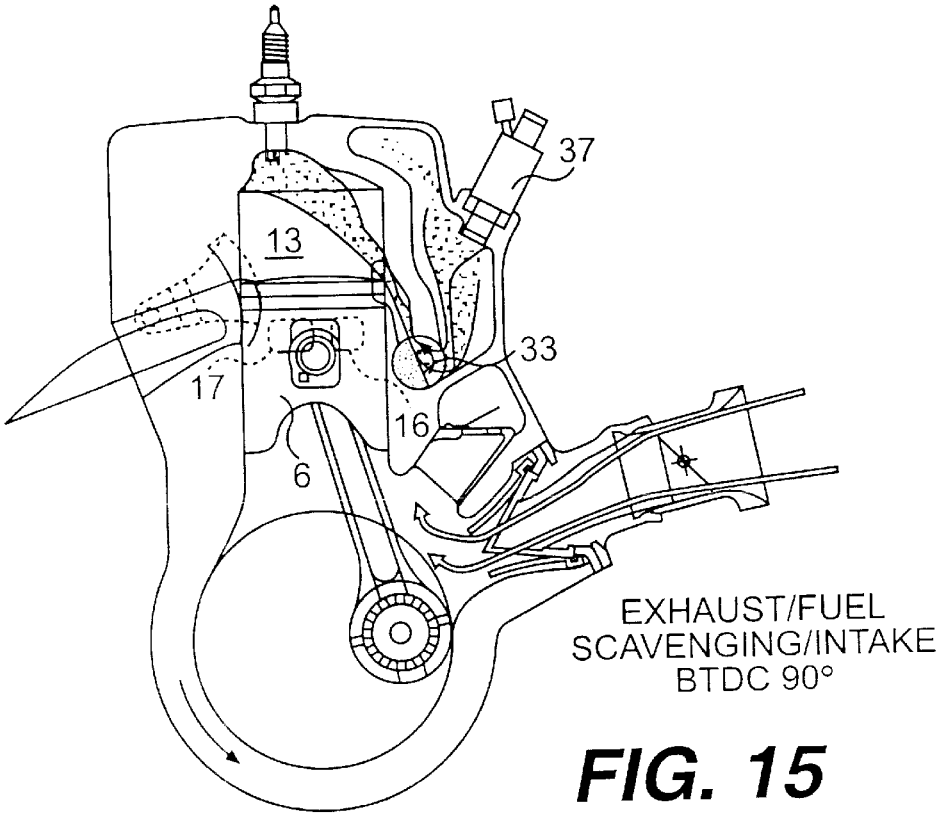
FIG. 15 illustrates a diagram showing a state of 90° before arrival at the top dead center (TDC)
Figure 16:
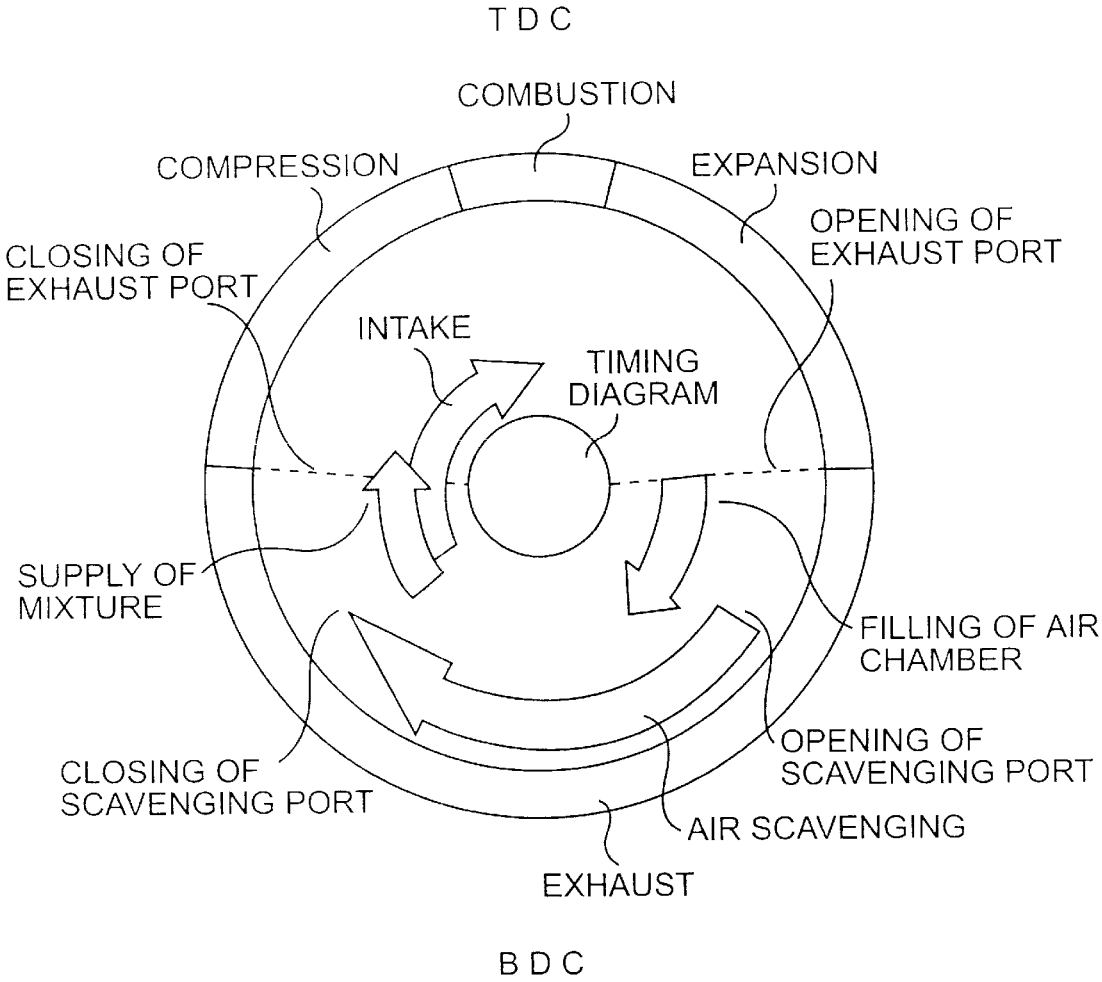
FIG. 16 is a view illustrating an operational cycle of the embodiment.
Figure 17:
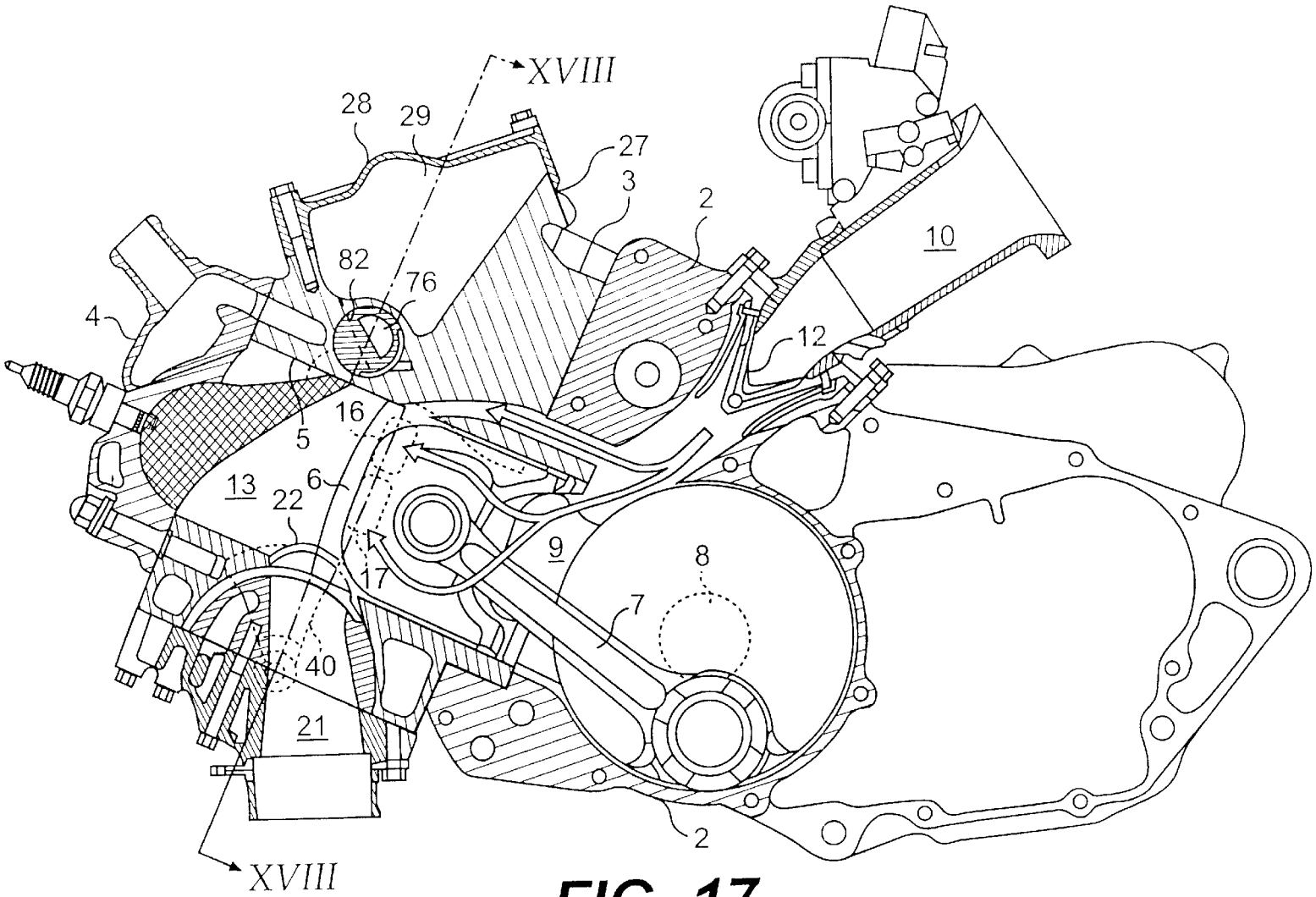
FIG. 17 is a vertical sectional view of a second embodiment of the present invention.
Figure 18:
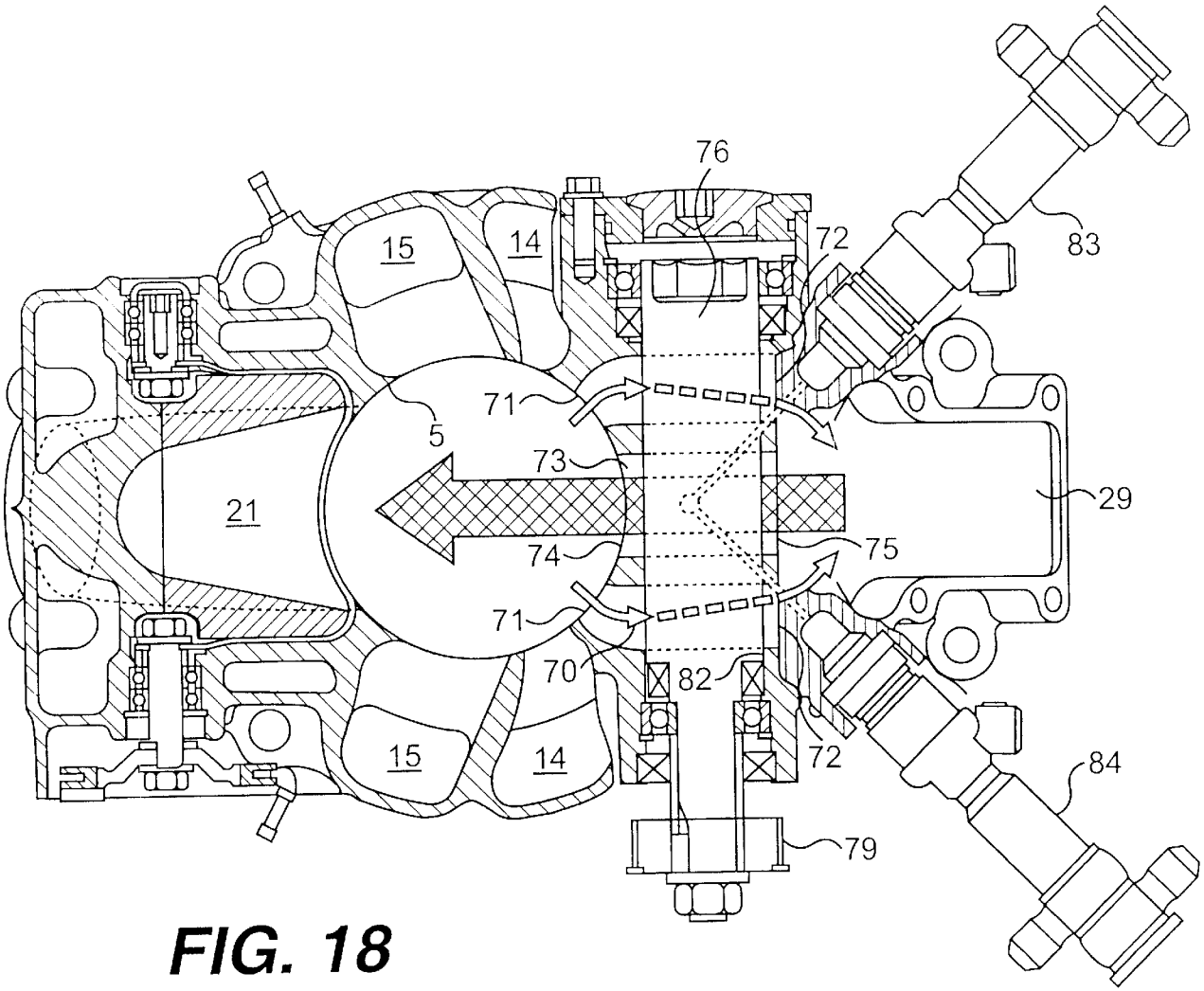
FIG. 18 is a transverse sectional view taken on line XVIII—XVIII of FIG. 17.

After the piston 6 reaches the top dead center (TDC), the mixture in the combustion chamber 13 burns and expands and the crank chamber 9 is compressed with the descent of the piston 6 to compress the air present in the crank chamber 9, as shown in FIG. 13.

At a point in time after an elapse of 90° from the top dead center (TDC), which varies depending on a vertical position of the exhaust control valve 40, the exhaust port 22 is opened to discharge the burned gas from the exhaust passage 21. At almost the same time, the air compressed in the crank chamber 9 flows from the air supply scavenging passage 14 located near the intake passage 10 into the air passage 24 through the air introducing grooves 25 and is then introduced from the air passage 24 into the chamber 29 through the reed valve 26.

At a point in time after an elapse of about 122° from the top dead center (TDC), the scavenging ports 16 and 17 are opened with the descent of the piston 6, resulting in the air (not containing fuel) present in the crank chamber 9 flows from the ports 16 and 17 into the combustion chamber 13 through the air supply scavenging passages 14 and 15 to force out the burned gas present in the combustion chamber 13 toward the exhaust port 22. In other words, the scavenging is effected with the air alone. At the same time, fuel is injected into the mixing chamber 31 from the fuel injection valves 37 and 39 to produce a rich mixture (see FIG. 14).

At a time point after an elapse of about 58° from the bottom dead center (BDC), the scavenging ports 16 and 17 are closed with the ascent of the piston 6 to stop the scavenging performed by the inflow of the air from both the ports. At almost the same time, the valve chamber 34 of the rotary valve 33 is opened to both the mixing chamber 31 and the rich mixture supply scavenging passage 18, so that the rich mixture present in the mixing chamber 31 passes through the rich mixture supply scavenging passage 18 and is supplied into the combustion chamber 13 through the scavenging port 19 to scavenge the remaining burned gas. Since the crank chamber 9 expands with the ascent of the piston 6, air is introduced into the crank chamber 9 from the intake passage 10 through the reed valve 12. In addition, the blow-by phenomenon of the mixture upon scavenging of the remaining burned gas only occurs to a small extent.

Thus, in the spark ignition type two-cycle internal combustion engine 1, since scavenging with only air is performed in the initial stage of scavenging, the blow-by phenomenon that the mixture passes through the combustion chamber 13 and is discharged to the exhaust passage 21, is prevented. This makes it possible to improve fuel economy and prevent air pollution caused by the unburned gas.

Since only air is supplied in the crank chamber 9, even if the bearing portion of the crank shaft 8 and the sliding portion between the cylinder bore 5 and the piston 6 are not lubricated with the oil mixed in the fuel, the oil is supplied from the oil pump 59 to the bearing portion of the crank shaft 8 and the sliding portion between the cylinder bore 5 and the piston 6 through the oil feed paths 63 and 64. Accordingly, the two-cycle internal combustion engine 1 can be operated in a state with a reduction in frictional loss, while preventing white-smoking caused by the oil mixed in the fuel.

Since the rotary valve 33 is provided at a point lower than the communication passage 32 which is in communication with the chamber 29 and the mixing chamber 31, even if the fuel supplied from the fuel injection valves 37, 39 into the mixing chamber 31 is stuck on an inner wall of the mixing chamber 31 and remains on a bottom portion of the mixing chamber 31 and in the valve chamber 34, the remaining fuel can be almost positively discharged into the combustion chamber 13. This makes it possible to, responsively control the supplied amount of the fuel into the combustion chamber 13 and hence to realize a stable combustion state.

Since the two fuel injection valves 37 and 39 are provided, not only a large amount of fuel can be injected but also a fine flow control of the fuel can be easily performed while maintaining the metering accuracy of the fuel at a high level.

Since the fuel injection valve 37 is disposed in a radial direction of the rotary valve 33 and the fuel injection valve 39 is disposed in the direction of the rotational axis of the rotary valve 33, both the valves 37 and 39 can be disposed near the rotary valve 33 without interference therebetween and thereby the fuel can be positively injected into the valve chamber 34 of the rotary valve 33. Further, the fuel can be prevented from remaining in the mixing chamber 31 by suppressing the amount of fuel injected from the fuel injection valve 37 and the sizes of the particles of the fuel injected from the fuel injection valves 37 and 39 can be made further reduced in size by collision of the particles of the fuel injected from the fuel injection valves 37, 39.

Since the fuel injection valve 39 is disposed on the rotational axis of the rotary valve 33, the fuel can be injected into the valve chamber 34 irrespective of the opening position of the valve chamber 34 in the rotary valve 33. The fuel injected from the fuel injection valve 39 can be sufficiently mixed with the sucked air by allowing the fuel to intersect a radial air current passing through the valve chamber 34 in the rotary valve 33, to thereby accelerate the atomization of the fuel.

Additionally, since the valve chamber 34 in the rotary valve 33 is in communication with the rich mixture supply scavenging passage 18 in a state after being previously in communication with the mixing chamber 31, even if the fuel in a liquid state remains in the vicinity of the rotary valve 33, such liquid fuel adheres on the rotary valve on the valve chamber 34 side and can be atomized by a current of air from the beginning of the next opening period.

Next, a second embodiment for carrying out the present invention will be described with reference to FIGS. 17 to 24.

In this embodiment, the air passage 24 which was provided in the first embodiment is omitted. Air is compressed to a high pressure at the compression stroke and is sucked from the combustion chamber 13 into the chamber 29 through a pair of air communication passages 70. In the chamber 29, the air sucked in is mixed with fuel which is injected from fuel injection valves 83, 84 in the same manner as in the first embodiment, to form a rich mixture. The resulting rich mixture is supplied into the combustion chamber 13 through a rich mixture supply scavenging passage 73 upon completion of the scavenging stroke (see FIG. 24).

Figure 24:
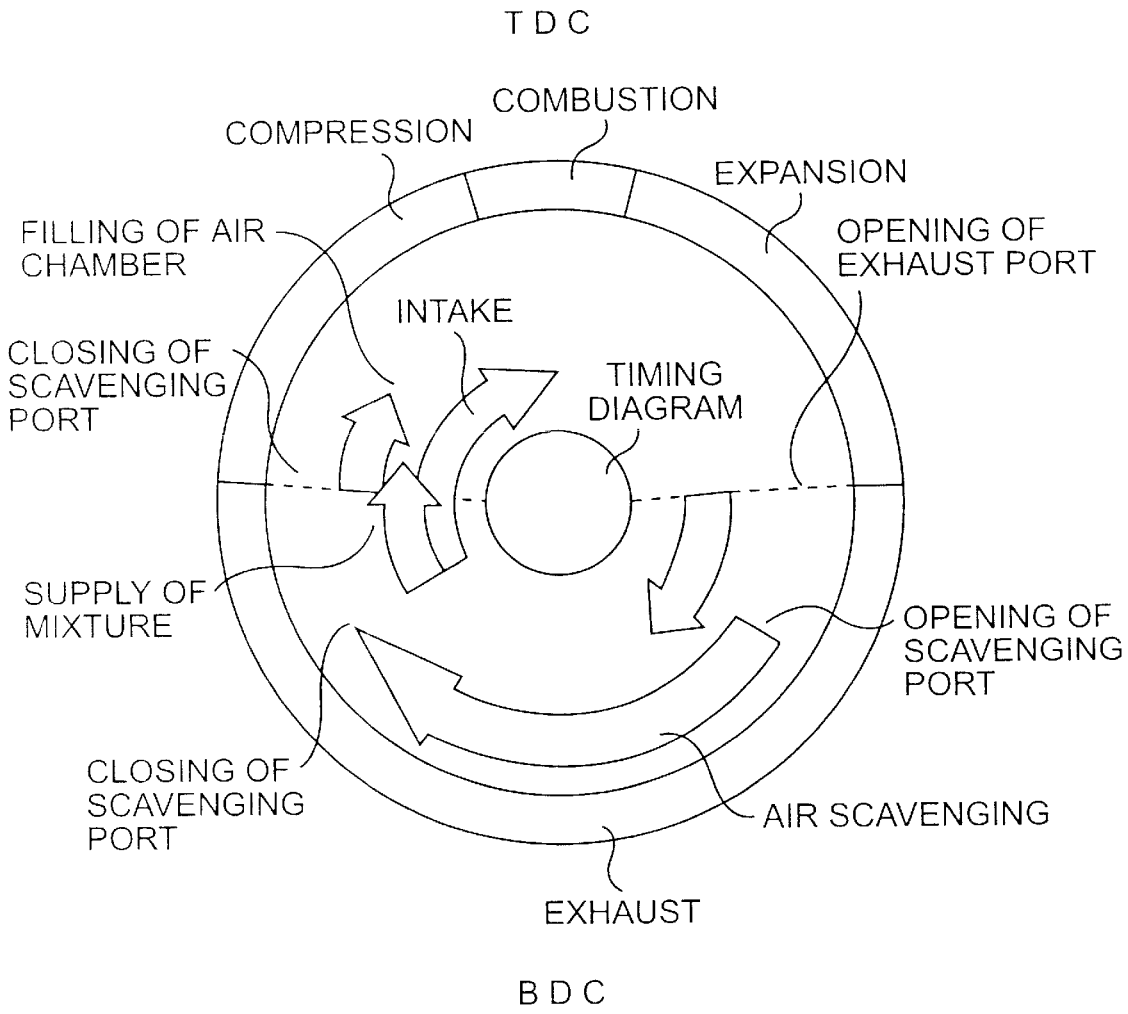
FIG. 24 is a view illustrating an operational cycle of the embodiment shown in FIG. 17.
Figure 25:
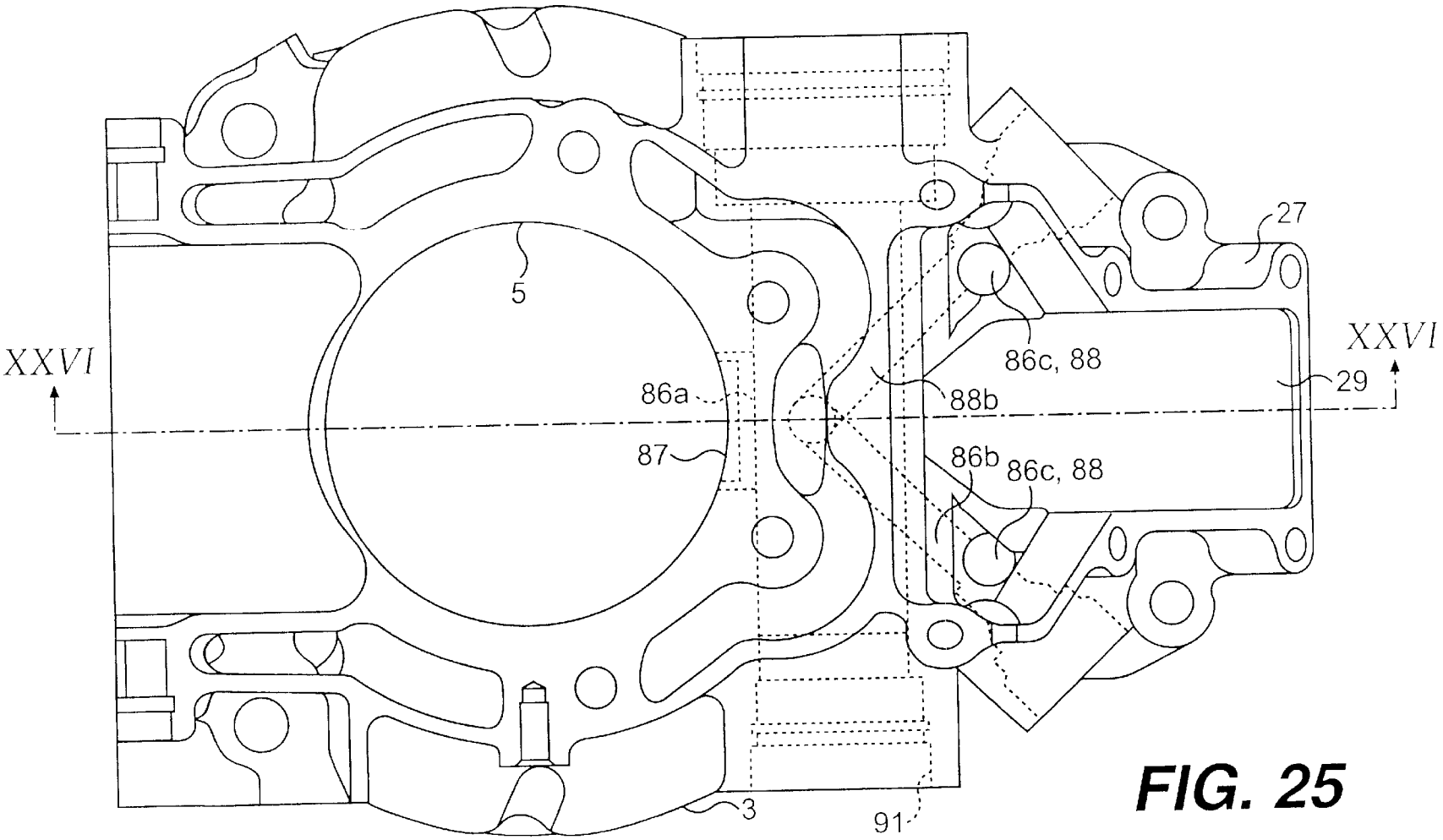
FIG. 25 is a plan view of a cylinder block in a third embodiment of the present invention.

The filling of the chamber 29 with the high pressure air supplied from the combustion chamber 13 starts simultaneously with the compression stroke after completion of the exhaust stroke as shown in FIG. 24, and stops after stopping of the supply of the rich mixture into the combustion chamber 13. The other operations are the same as those in the first embodiment, and therefore, the explanation thereof is omitted.

Next, there will be described a means of realizing, according to this embodiment, the timing of the filling of the chamber 29 with highly compressed air supplied from the combustion chamber 13 and of stopping the filling and the timing of the supply of a rich mixture from the chamber 29 into the combustion chamber 13 and stopping the supply of the rich mixture.

A control valve capable of commonly opening/closing the pair of the air passages 70 and the rich mixture supply scavenging passage 73 is interposed therein. Such a control valve is a rotary valve as in the first embodiment.

The rotary valve 76 is fitted in a valve receiving hole 82, and the pair of the air passages 70 and the rich mixture gas supply scavenging passage 72 are opened in the valve receiving hole 81.

Figure 21:
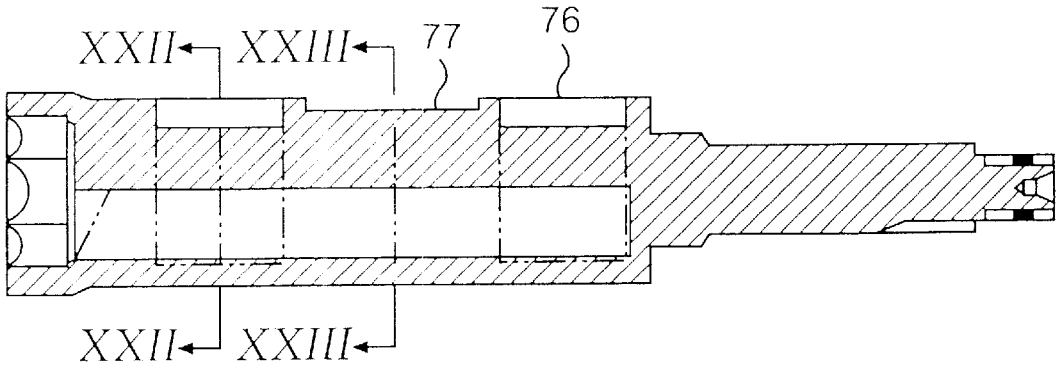
FIG. 21 is a partial vertical sectional view of the rotary valve in the embodiment shown in FIG. 17.
Figure 22:
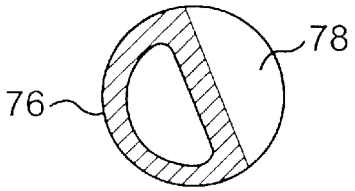
FIG. 22 is a vertical sectional view taken on line XXII—XXII of FIG. 21.
Figure 23:
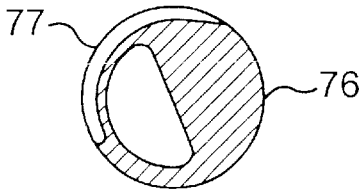
FIG. 23 is a vertically sectional side view taken on line XXIII—XXIII of FIG. 21.

As shown in FIGS. 21 to 23, a cutout 77 having a specific length in the peripheral direction and a cutout 78 formed in a substantially crescent in cross-section for opening the pair of the air passages 70 and the rich mixture supply scavenging passage 73 are formed around an outer periphery of the rotary valve 76 at positions corresponding to the pair of the air passages 70 and the rich mixture supply scavenging passage 73. These cutouts can realize the timing of the filling the chamber 29 with highly compressed air supplied from the combustion chamber 13 and of stopping the filling and the timing of the supply of a rich mixture from the chamber 29 into the combustion chamber 13 and stopping the supply of the rich mixture as shown in FIG. 24.

Figure 20:
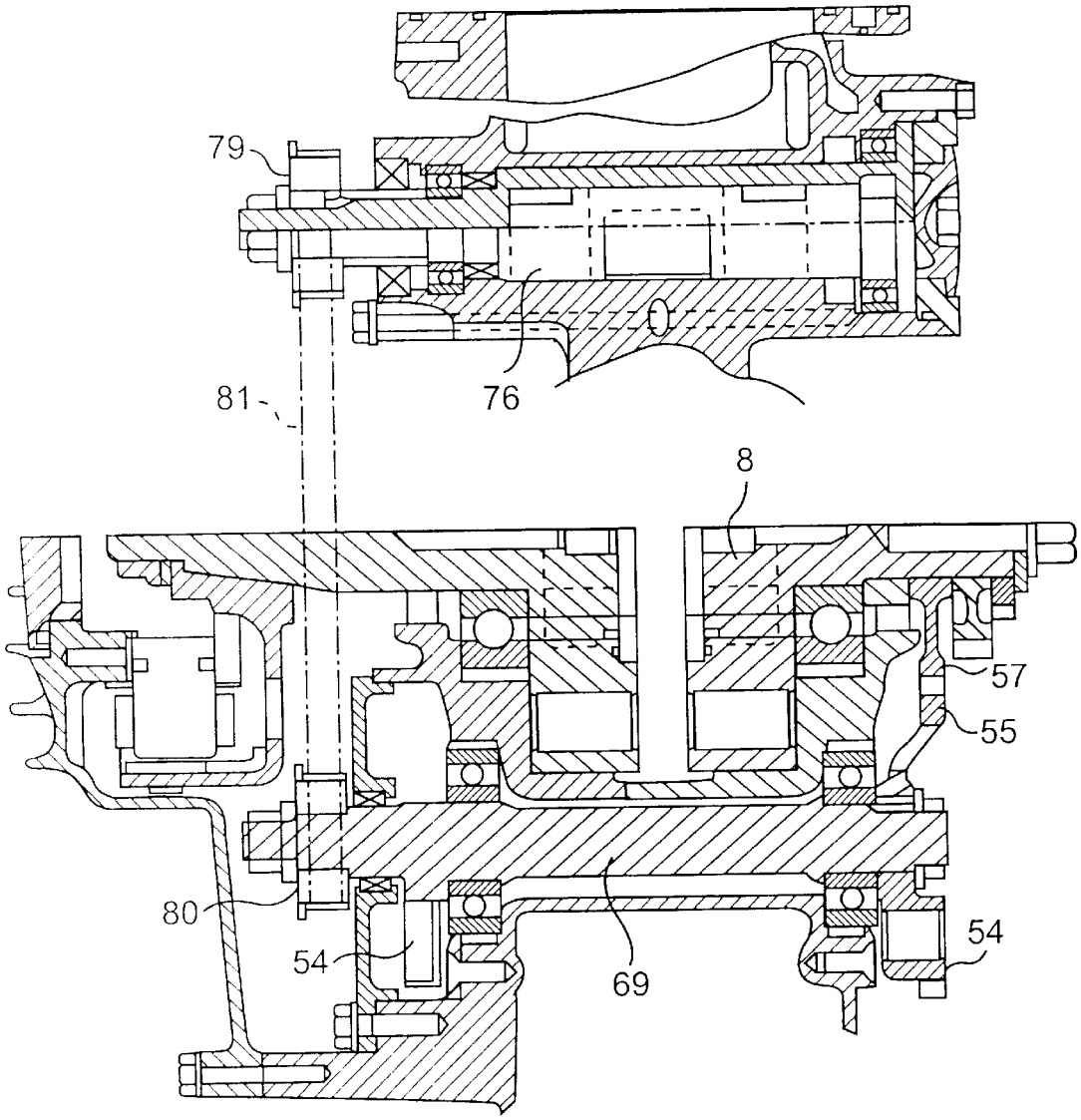
FIG. 20 is a vertical sectional side view showing a schematic configuration of a mechanism of transmitting power between a crank shaft and a rotary valve in the embodiment shown in FIG. 17.

A pulley 79 is integrally mounted at an axial end of the rotary valve 76. As shown in FIG. 20, a cog belt 81 is provided between the pulley 79 and a pulley 80 integrally mounted on a balancer shaft 69. When the spark ignition type two-cycle internal combustion engine 1 is operated, the crank shaft 8 is rotated and thereby the drive gear 57 integrally mounted on the crank shaft 8 meshes with the balanced gear 55, so that the balancer weight 54 integrally mounted on the balancer shaft 69 is rotated in the reversed direction to the crank shaft 8 and the rotary valve 76 is also rotated in the reversed direction of the crank shaft 8, each at the same rotational speed as that of the crank shaft 8.

Figure 19:
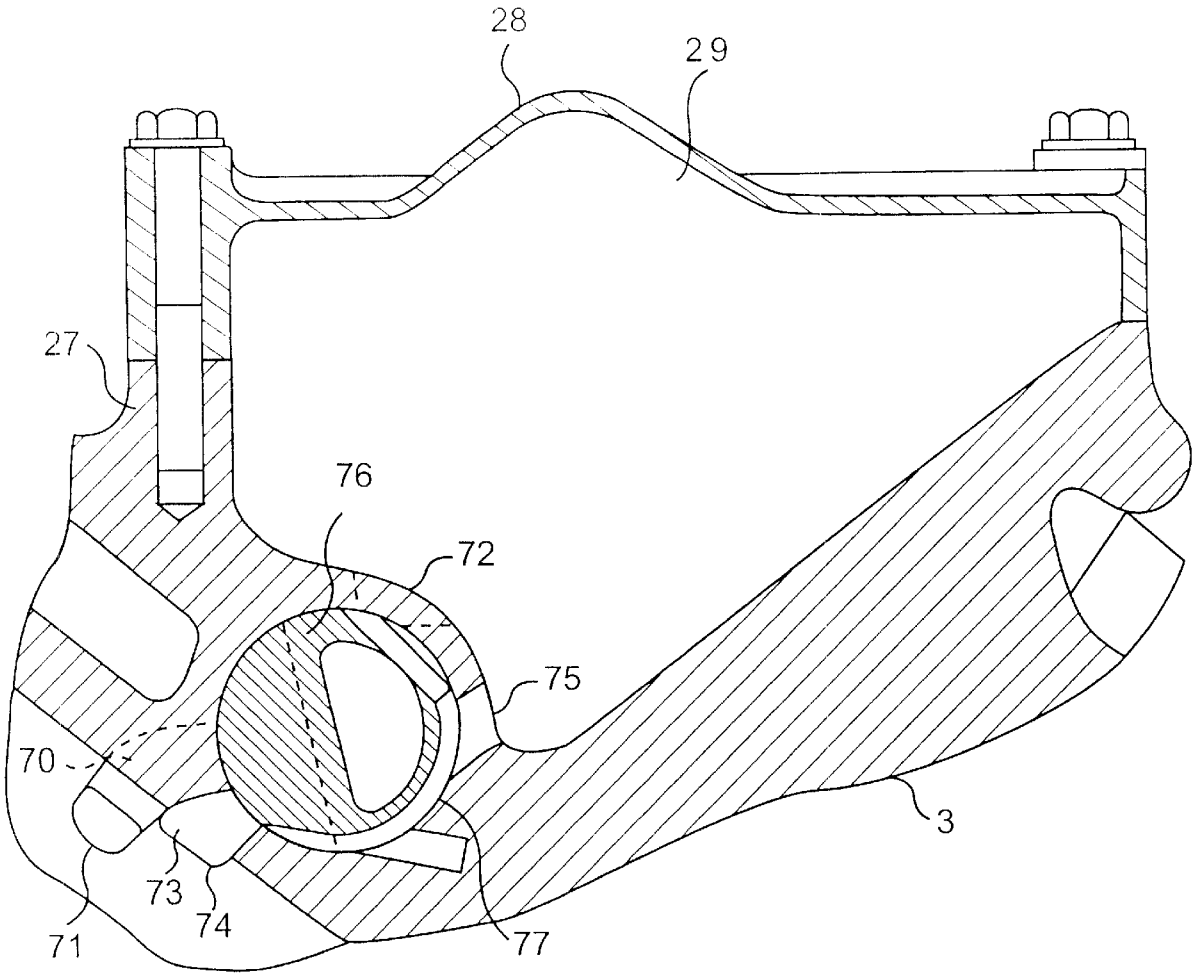
FIG. 19 is an enlarged view of a principal portion of FIG. 17.

The cutout 77 as a fuel control portion of the rotary valve 76 is, as fully shown in FIG. 19, set to be positioned lower than a mixture suction port 75 as a communication portion of the rich mixture supply scavenging passage 73 to the chamber 29 when the cutout 77 controls the flow of the rich mixture passing through the rich mixture supply scavenging passage 73. In addition, a mixture injection port 74 is provided as a communication portion of the rich mixture supply scavenging passage 73 to the combustion chamber 13. Further, a highly compressed air suction port 71 is provided as a communication portion of the air passage 70 to the combustion chamber 13. A highly compressed air injection port 72 is a communication portion for the air passage 70 and the chamber 29.

In this embodiment, since the chamber 29 is filled with the air supplied from the combustion chamber 13 under the compression stroke through the pair of the air passages 70 as described above, a higher and nearly constant pressure in the combustion chamber 13 can be used for the filling the chamber 29 with the air. Accordingly, as compared with the filling of the chamber 29 with air using a pressure in the crank chamber 9 in the first embodiment, it is possible to obtain a positive, stable and high chamber pressure without being affected by a reduction in pressure due to a full-opening of a throttle valve accompanied by the increased engine speed.

Since the rich mixture obtained by filling the chamber 29 with air flows in the combustion chamber 13 which has been sufficiently scavenged with the air (not mixed with fuel) passing through the air supply scavenging passages 14, 15, it is possible to fill the combustion chamber 13 with a mixture at a suitable concentration, and hence to realize a desirable combustion state. This is effective to improve fuel economy and attain a high exhaust gas purifying performance. Since highly compressed air for forming a rich mixture is obtained from the combustion engine 13, the rotary valve 76 in the communication passage for communicating the chamber 29 to the combustion chamber 13 can be provided on a cylinder wall near the combustion chamber 13, so that the length of the communication passage between the rotary valve 76 and the mixture injection port 74 can be shortened, thereby reducing an amount of the air required to allow the fuel to pass through the communication passage.

In addition, a time required for the fuel to pass through the communication passage can be shortened, to reduce the effect of the time factor on the setting of the timing for the opening of the rotary valve 76. This makes it possible to easily set the timing of the opening of the rotary valve 76 and to improve the suitability of the set-up timing of the opening of the rotary valve 76 to rotational speeds over a wide range.

Since the cutout 77 of the rotary valve 76 opens and closes the rich mixture supply scavenging passage 79 and the portion of actually controlling the flow of the rich mixture (control portion of the rotary valve 76) is positioned lower than the mixture suction port 75, even if the fuel injected from the fuel injection valves 83, 84 adheres on an inner wall of the chamber 29 and remains on a bottom portion of the chamber and the lowermost portion of the rich mixture supply scavenging passage 73 communicated with the chamber 29 and in the rotary valve 76, the remaining fuel can be almost positively discharged into the combustion chamber 13, with the result that the amount of the fuel supplied into the combustion chamber 13 can be suitably, responsively performed to result in a stable combustion state.

Next, a third embodiment for carrying out the present invention will be described with reference to FIGS. 25 to 34. In this embodiment, a common communication 86 is provided in place of the pair of the air passages 70 and the rich mixture supply scavenging passage 73 in the second embodiment, and correspondingly, only one cutout 90 of a rotary valve 89 is provided as shown in FIG. 29.

Accordingly, the filling of the chamber 29 with highly compressed air supplied from the combustion chamber 13 and the supply of a rich mixture from the chamber 29 into the combustion chamber 13 are both performed through the common communication passage 86 when the communication passage 86 is opened through the cutout 90 of the rotary valve 89. The pressure for the filling of the highly compressed air and the supply of the rich mixture into respective chambers are based on a pressure balance between both the chambers.

Figure 34:
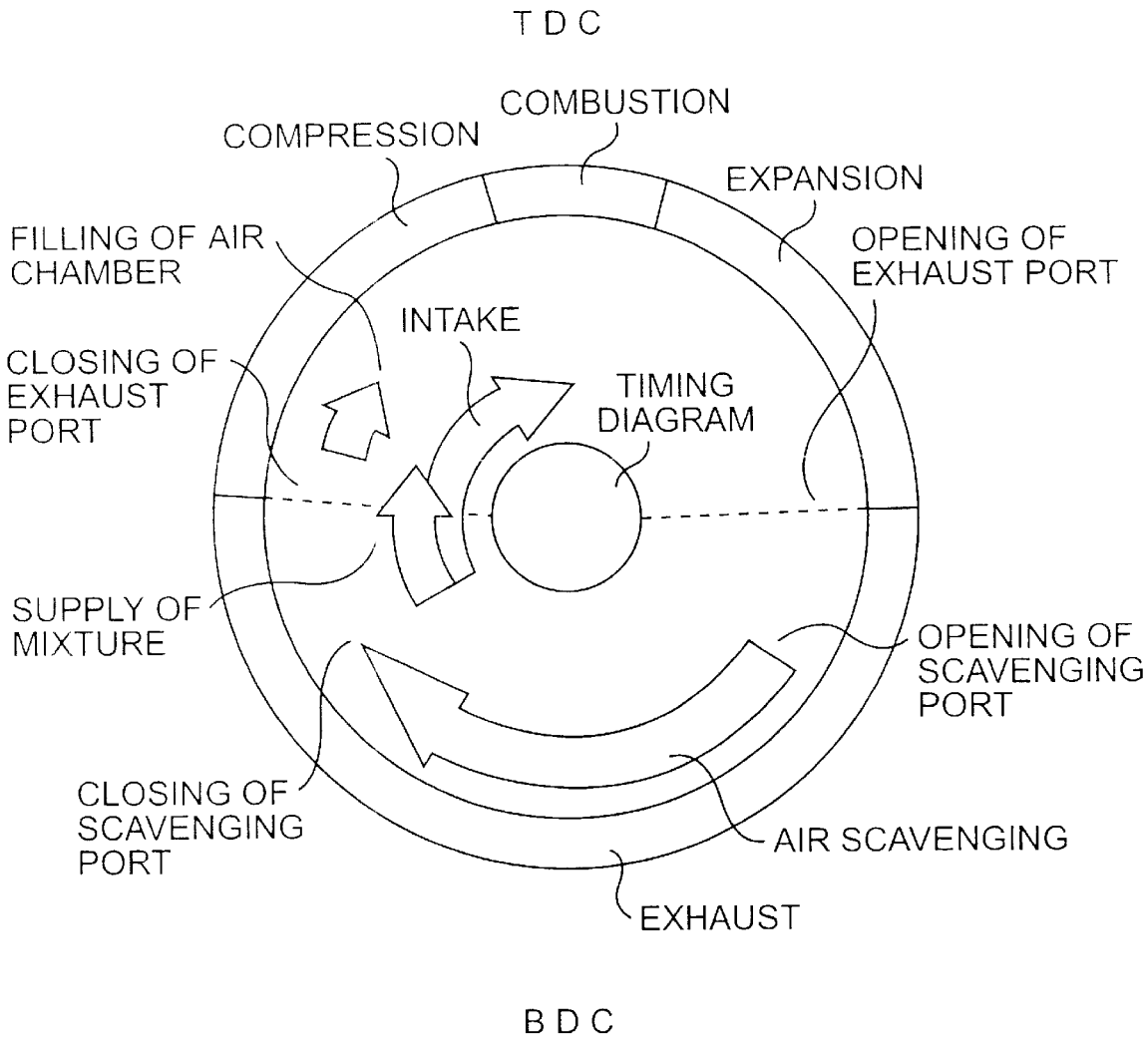
FIG. 34 is a view illustrating an operational cycle of the embodiment shown in FIG. 25.

As shown in FIG. 34, the timing of the stopping and the filling of the chamber 29 with highly compressed air supplied from the combustion chamber 13 and the timing of the supply of the rich mixture from the chamber 29 into the combustion chamber 13 and of the stopping of the supply of the rich mixture are the same as those in the second embodiment.

On the contrary, the timing of the starting of the filling of the chamber 29 with the highly compressed air supplied from the combustion chamber 13 is different from that in the second embodiment in that it corresponds to the time when the pressure balance in the combustion chamber 13 is equalized to that of the chamber 29 and the supply of the rich mixture from the chamber 29 to the combustion chamber 13 is stopped due to the fact that the communication passage 86 is continuously in communication from the starting of the supply of the rich mixture from the chamber 29 into the combustion chamber 13 to the stopping of the filling of the chamber 29 with the highly compressed air supplied by the combustion chamber 13 by the action of the cutout 90 having the specific length in the circumferential direction of the rotary valve 89.

Figure 26:
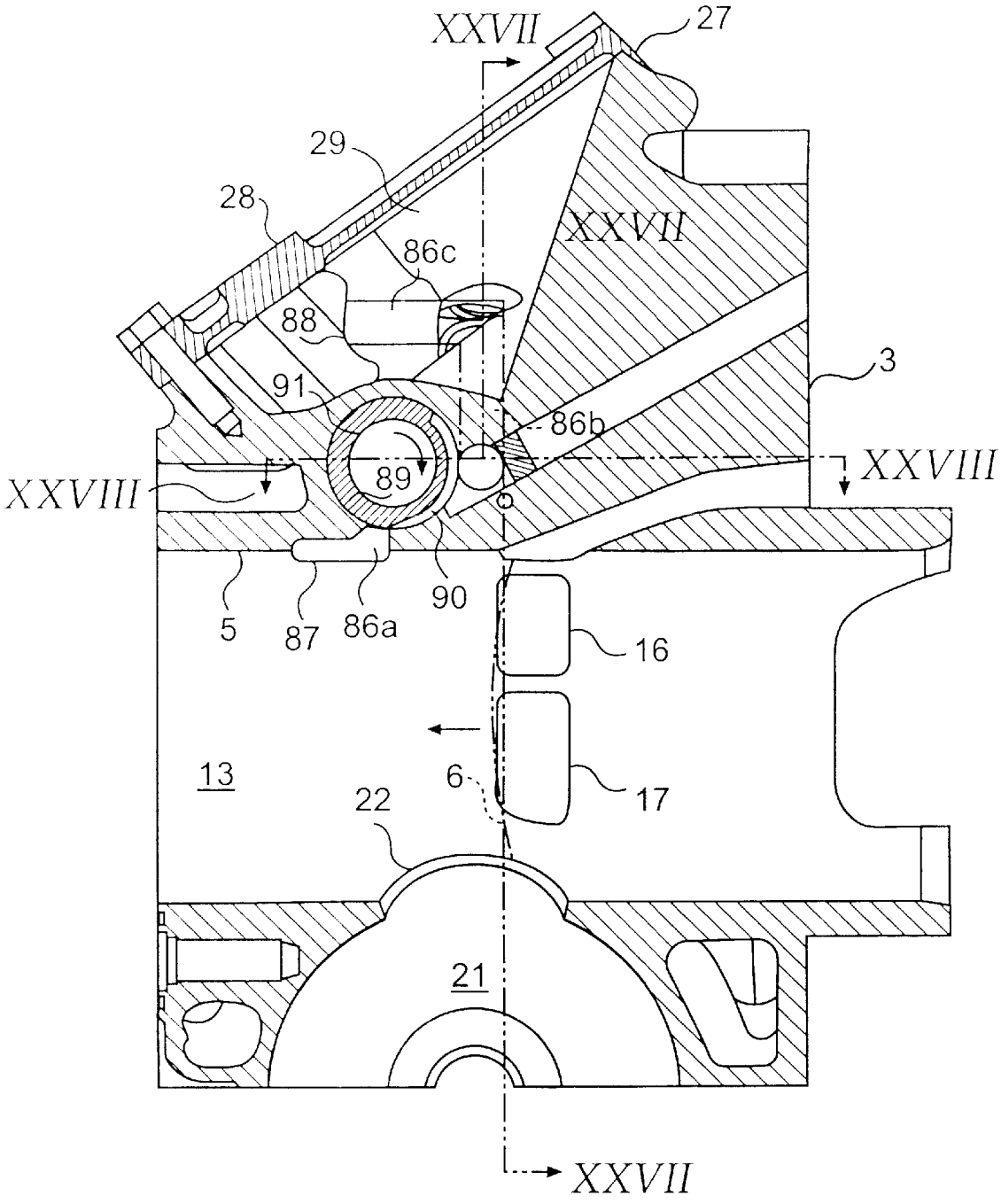
FIG. 26 is a vertical sectional side view taken on line XXVI—XXVI of FIG. 25, showing a state in which a cover is mounted.
Figure 27:
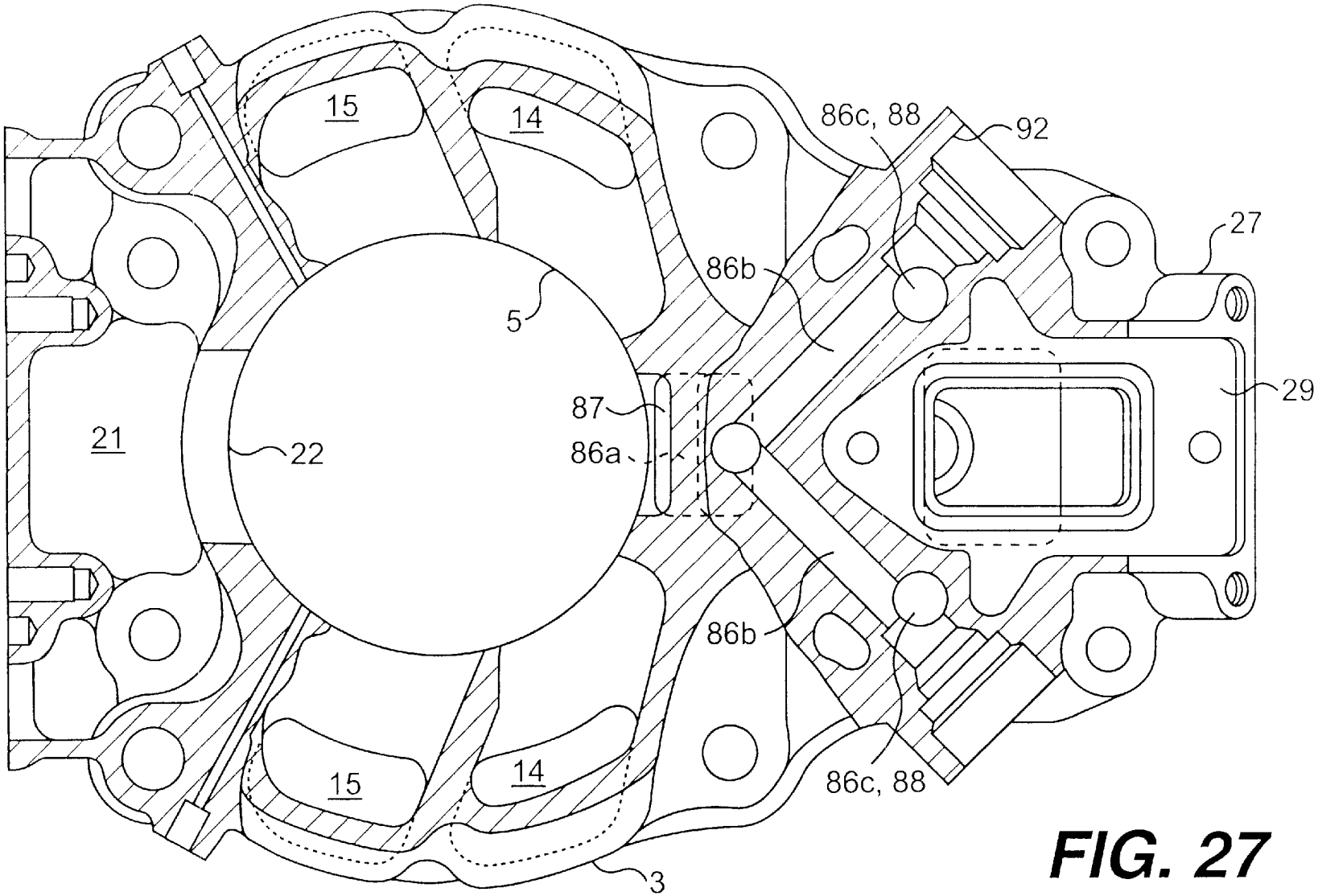
FIG. 27 is a transverse sectional plan view taken on line XXVII—XXVII of FIG. 26, showing a state in which the cover is removed.
Figure 28:
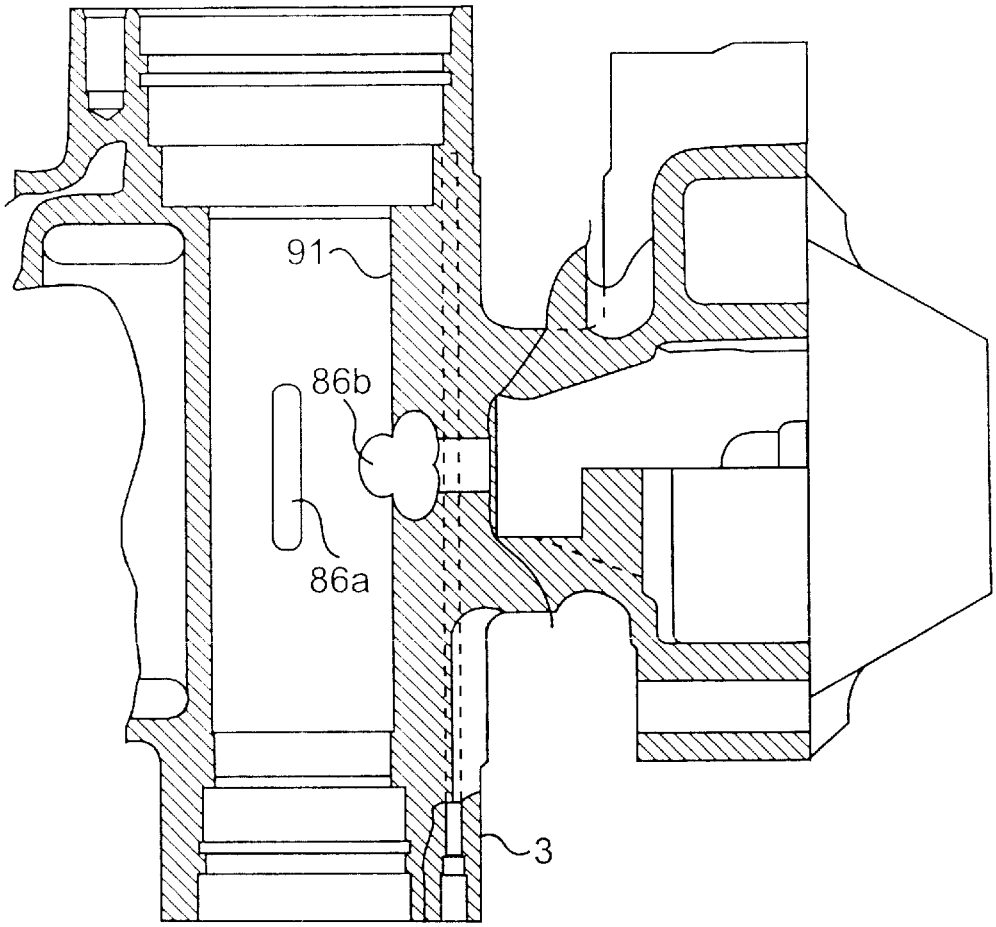
FIG. 28 is a vertical sectional side view taken on line XXVIII—XXVIII of FIG. 26.
Figure 29:
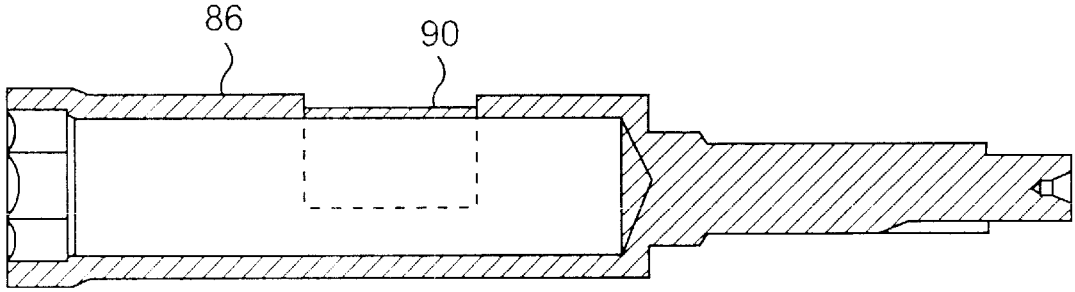
FIG. 29 is a partly vertical sectional view of a rotary valve in the embodiment shown in FIG. 28.
Figure 30:
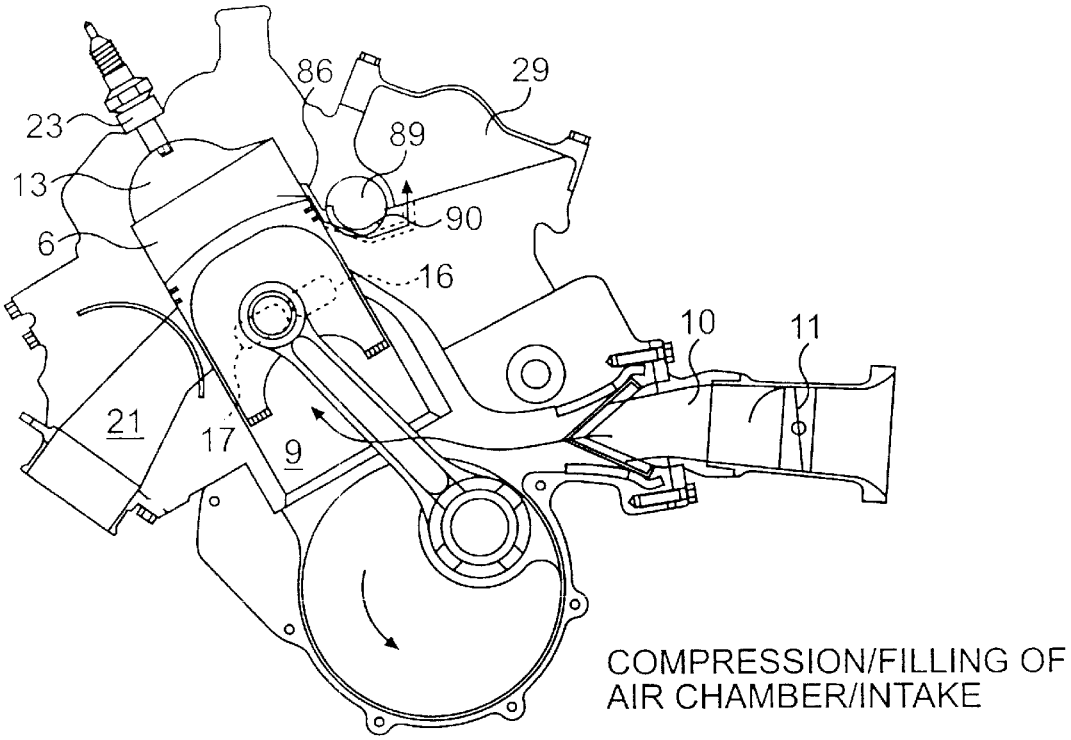
FIG. 30 is a diagram showing a state at the time of compression/filling of air chamber/suction in the embodiment shown in FIG. 25.
Figure 31:
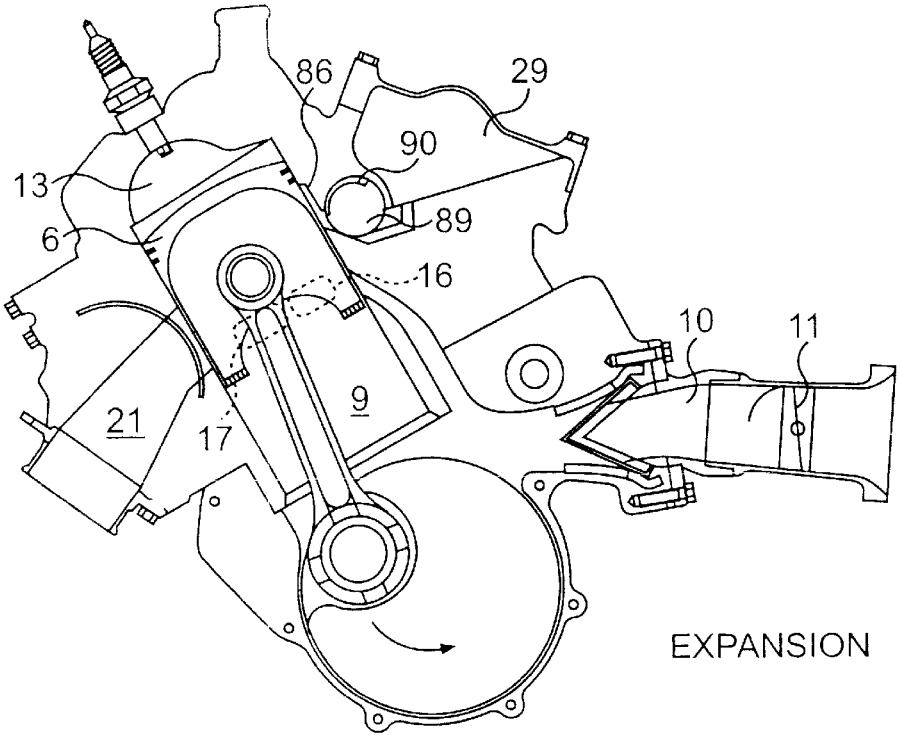
FIG. 31 is a diagram, similar to FIG. 30, showing a state at the time of expansion.
Figure 32:
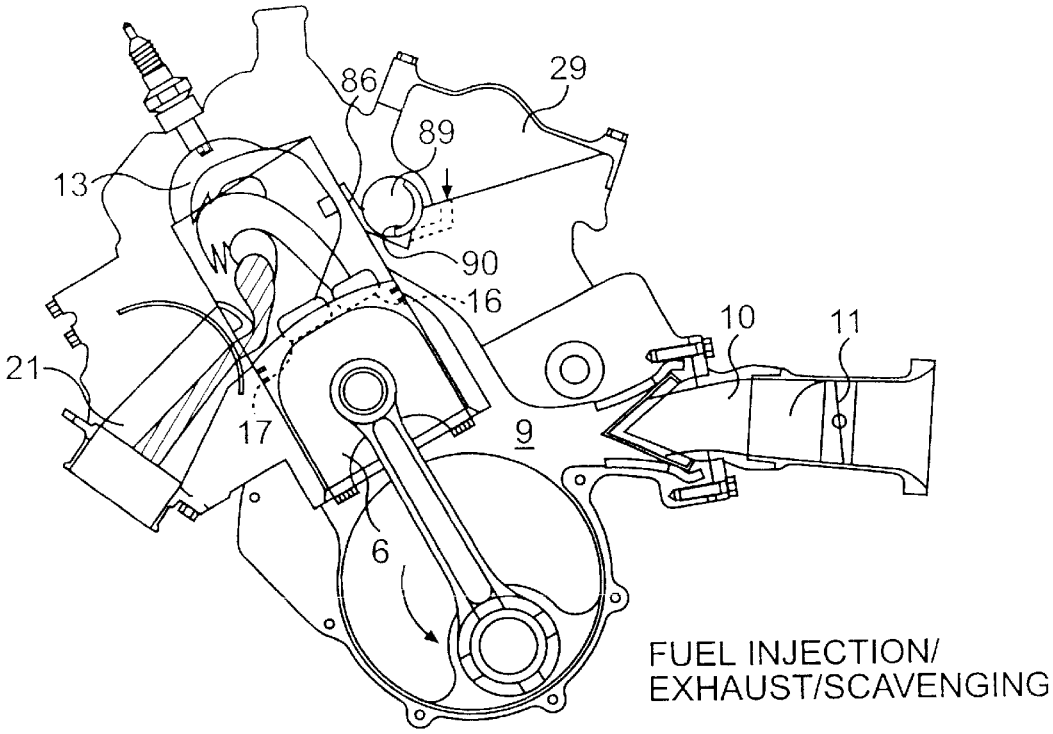
FIG. 32 is a diagram, similar to FIG. 30, showing a state a t the time of fuel injection/exhaust/scavenging.
Figure 33:
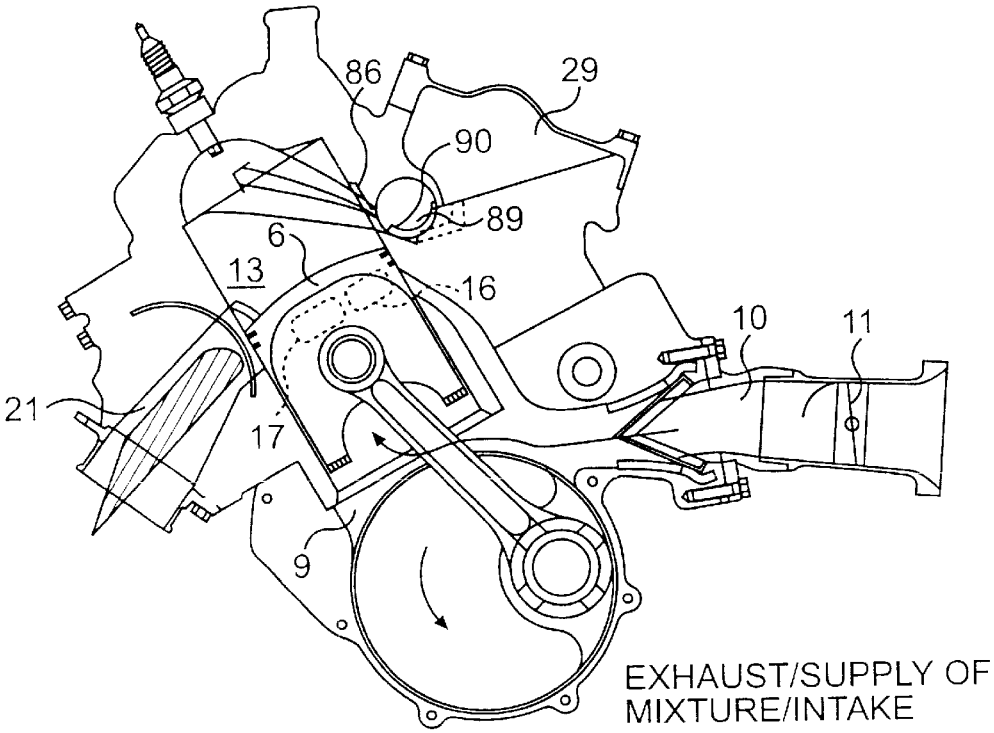
FIG. 33 is a diagram, similar to FIG. 30, showing a state at the time of exhaust/supply of mixture/suction.

Since the port 87, as the communication portion of the communication passage 86 to the combustion chamber 13, is enlarged in its longitudinal length and also has a cross-section with both sides thereof largely expanded towards the combustion chamber 13 in order to facilitate the suction of a sufficient amount of the highly compressed air into the chamber 29 (see FIGS. 26, 28).

In this embodiment, the communication passage 86 includes a communication passage 86*a*, an obliquely, upwardly extending communication passage 86*b*, and an obliquely, upwardly extending communication passage 86*c* bend perpendicularly from the communication passage 86*b*. The communication passages 86*a*, 86*b* are respectively disposed on the combustion chamber 13 side and the chamber 29 side with respect to the control portion of the rotary valve 89. An end portion of the communication passage 86*c* is in communication with the chamber 29 through an opening 88.

The fuel injected from two fuel injection valves (not shown) passes through the right and left portions of the communication passage 86*b* and is mixed with highly compressed air sucked from the chamber 29 through the communication passage 86*c*, to form a rich mixture. The resulting rich mixture is injected into the combustion chamber 13 through the control portion of the rotary valve 89.

Accordingly, since the control portion of the rotary valve 89 is positioned lower than the portion of the communication passage 86*c* bend perpendicularly to the communication passage 86*b* (the portion at which the air sucked from the chamber 29 collides with the injected fuel) as well as the opening 88, even if the fuel remains in the communication passage 86*b* and in the control portion of the rotary valve 89, the remaining fuel is almost positively discharged into the combustion chamber 13 by the strong mixed air flow moved by an intermittent opening/closing of the rotary valve 89. As a result, it is possible to suitably, responsively control the amount of the fuel supplied into the combustion chamber 13, and hence to obtain a stable combustion state.

The detailed explanation of the various states of the engine at points of compression/filling of the air chamber/suction, expansion, fuel injection/exhaust/scavenging, and exhaust/supply of mixture/suction shown in FIGS. 30 to 33 is omitted.

In addition, an opening 88 is provided as a communicating portion of the communication passage 86 to the chamber 29. A receiving hole 91 is provided for the rotary valve 89, and 92 is a fuel injection valve mounting hole.

According to the embodiment having the above configuration, it is possible to simplify the structure of the highly compressed air passage and the rich mixture supply scavenging passage as well as the structure of the control valve, and hence to facilitate the manufacture thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A two-cycle internal combustion engine comprising:

a combustion chamber;

a first fuel injection device;

a chamber being contiguous to said first fuel injection device and being juxtaposed on a side of said combustion chamber;

a communication passage being disposed between said combustion chamber and said chamber contiguous to said first fuel injection device, a communication portion through which said communication passage is communicated with said chamber contiguous to said first fuel injection device, said communication portion being disposed at a first predetermined height relative to said chamber;

a control valve being disposed in said communication passage for operatively controlling said communication passage for selectively communicating said combustion chamber with said chamber contiguous to said first fuel injection device;

a second fuel injection device being disposed in a direction of a rotational axis of said control valve;

said first fuel injection device being provided for supplying fuel into said combustion chamber via said communication passage; and wherein at least a control portion of said control valve being positioned at a second predetermined height being lower relative to said first predetermined height of said communication portion through which said communication passage is communicated to said chamber contiguous to said first fuel injection device, and at least a control portion of said control valve is positioned lower than a relative position of said fuel injection device and said scavenging port.

2. The two-cycle internal combustion engine according to claim 1, wherein said control valve opens said communication passage approximately upon closing of a scavenging port after a down dead center of said engine, and closes said communication passage in the midway of the compression stroke after closing of an exhaust port.

3. The two-cycle internal combustion engine according to claim 1, wherein said control valve is a rotary valve rotating in interlocking rotation with a crank shaft of said engine.

4. The two-cycle internal combustion engine according to claim 2, wherein said control valve is a rotary valve rotating in interlocking rotation with a crank shaft of said engine.

5. The two-cycle internal combustion engine according to claim 1, wherein said chamber contiguous to said first fuel injection device is communicated to a crank chamber of said engine, and said communicating portion includes a gate valve for communicating said crank chamber to said chamber contiguous to said first fuel injection device at the exhaust stroke of said engine.

6. The two-cycle internal combustion engine according to claim 2, wherein said chamber contiguous to said first fuel injection device is communicated to a crank chamber of said engine, and said communicating portion includes a gate valve for communicating said crank chamber to said chamber continuous to said first fuel injection device at the exhaust stroke of said engine.

7. The two-cycle internal combustion engine according to claim 3, wherein said chamber contiguous to said first fuel injection device is communicated to a crank chamber of said engine, and said communicating portion includes a gate valve for communicating said crank chamber to said chamber continuous to said first fuel injection device at the exhaust stroke of said engine.

8. The two-cycle internal combustion engine according to claim 1, wherein said communication passage includes a first communication passage through which highly compressed air flows from said combustion chamber to said chamber contiguous to said first fuel injection device and a second communication passage through which a mixture flows from said chamber contiguous to said first fuel injection device to said combustion chamber and a first control valve provided in said first communication passage opens said first communication passage approximately upon closing of the exhaust port and closes said first communication passage in the midway of the compression stroke, and a second control valve provided in said second communication passage opens said second communication passage upon closing of a scavenging port and closes said second communication passage before closing of said first communication passage in the midway of the compression stroke.

9. The two-cycle internal combustion engine according to claim 2, wherein said communication passage includes a first communication passage through which highly compressed air flows from said combustion chamber to said chamber contiguous to said first fuel injection device and a second communication passage through which a mixture flows from said chamber contiguous to said first fuel injection device to said combustion chamber and a first control valve provided in said first communication passage opens said first communication passage approximately upon closing of the exhaust port and closes said first communication passage in the midway of the compression stroke, and a second control valve provided in said second communication passage opens said second communication passage upon closing of the scavenging port and closes said second communication passage before closing of said first communication passage in the midway of the compression stroke.

10. The two-cycle internal combustion engine according to claim 3, wherein said communication passage includes a first communication passage through which highly compressed air flows from said combustion chamber to said chamber contiguous to said first fuel injection device and a second communication passage through which a mixture flows from said chamber contiguous to said first fuel injection device to said combustion chamber and a first control valve provided in said first communication passage opens said first communication passage approximately upon closing of the exhaust port and closes said first communication passage in the midway of the compression stroke, and a second control valve provided in said second communication passage opens said second communication passage upon closing of the scavenging port and closes said second communication passage before closing of said first communication passage in the midway of the compression stroke.

11. The two-cycle internal combustion engine according to claim 8, wherein said first communication passage and said second communication passage are formed of a common communication passage.

12. The two-cycle internal combustion engine according to claim 9, wherein said first communication passage and said second communication passage are formed of a common communication passage.

13. The two-cycle internal combustion engine according to claim 10, wherein said first communication passage and said second communication passage are formed of a common communication passage.

14. The two-cycle internal combustion engine according to claim 1, wherein said first fuel injection device is disposed in a radial direction of said control valve.

15. The two-cycle internal combustion engine according to claim 1, further comprising a second fuel injection device being positioned essentially orthogonal to said first fuel injection device.

16. A two-cycle internal combustion engine comprising:

a combustion chamber;

a first fuel injection device;

a chamber being contiguous to said first fuel injection device and being juxtaposed on a side of said combustion chamber;

a communication passage being disposed between said combustion chamber and said chamber contiguous to said first fuel injection device, a communication portion through which said communication passage is communicated with said chamber contiguous to said first fuel injection device, said communication portion being disposed at a first predetermined height relative to said chamber;

a control valve being disposed in said communication passage for operatively controlling said communication passage for selectively communicating said combustion chamber with said chamber contiguous to said first fuel injection device;

said first fuel injection device being provided for supplying fuel into said combustion chamber via said communication passage and is disposed in a radial direction of said control valve; and wherein at least a control portion of said control valve being positioned at a second predetermined height being lower relative to said first predetermined height of said communication portion through which said communication passage is communicated to said chamber contiguous to said first fuel injection device, and at least a control portion of said control valve is positioned lower than a relative position of said fuel injection device and said scavenging port.

17. The two-cycle internal combustion engine according to claim 16, wherein said control valve opens said communication passage approximately upon closing of a scavenging port after a down dead center of said engine, and closes said communication passage in the midway of the compression stroke after closing of an exhaust port.

18. The two-cycle internal combustion engine according to claim 16, wherein said control valve is a rotary valve rotating in interlocking rotation with a crank shaft of said engine.

19. The two-cycle internal combustion engine according to claim 17, wherein said control valve is a rotary valve rotating in interlocking rotation with a crank shaft of said engine.

20. The two-cycle internal combustion engine according to claim 16, wherein said chamber contiguous to said first fuel injection device is communicated to a crank chamber of said engine, and said communicating portion includes a gate valve for communicating said crank chamber to said chamber contiguous to said first fuel injection device at the exhaust stroke of said engine.

21. The two-cycle internal combustion engine according to claim 17, wherein said chamber contiguous to said first fuel injection device is communicated to a crank chamber of said engine, and said communicating portion includes a gate valve for communicating said crank chamber to said chamber continuous to said first fuel injection device at the exhaust stroke of said engine.

22. The two-cycle internal combustion engine according to claim 18, wherein said chamber contiguous to said first fuel injection device is communicated to a crank chamber of said engine, and said communicating portion includes a gate valve for communicating said crank chamber to said chamber continuous to said first fuel injection device at the exhaust stroke of said engine.

23. The two-cycle internal combustion engine according to claim 16, wherein said communication passage includes a first communication passage through which highly compressed air flows from said combustion chamber to said chamber contiguous to said first fuel injection device and a second communication passage through which a mixture flows from said chamber contiguous to said first fuel injection device to said combustion chamber and a first control valve provided in said first communication passage opens said first communication passage approximately upon closing of the exhaust port and closes said first communication passage in the midway of the compression stroke, and a second control valve provided in said second communication passage opens said second communication passage upon closing of a scavenging port and closes said second communication passage before closing of said first communication passage in the midway of the compression stroke.

24. The two-cycle internal combustion engine according to claim 17, wherein said communication passage includes a first communication passage through which highly compressed air flows from said combustion chamber to said chamber contiguous to said first fuel injection device and a second communication passage through which a mixture flows from said chamber contiguous to said first fuel injection device to said combustion chamber and a first control valve provided in said first communication passage opens said first communication passage approximately upon closing of the exhaust port and closes said first communication passage in the midway of the compression stroke, and a second control valve provided in said second communication passage opens said second communication passage upon closing of the scavenging port and closes said second communication passage before closing of said first communication passage in the midway of the compression stroke.

25. The two-cycle internal combustion engine according to claim 18, wherein said communication passage includes a first communication passage through which highly compressed air flows from said combustion chamber to said chamber contiguous to said first fuel injection device and a second communication passage through which a mixture flows from said chamber contiguous to said first fuel injection device to said combustion chamber and a first control valve provided in said first communication passage opens said first communication passage approximately upon closing of the exhaust port and closes said first communication passage in the midway of the compression stroke, and a second control valve provided in said second communication passage opens said second communication passage upon closing of the scavenging port and closes said second communication passage before closing of said first communication passage in the midway of the compression stroke.

26. The two-cycle internal combustion engine according to claim 23, wherein said first communication passage and said second communication passage are formed of a common communication passage.

27. The two-cycle internal combustion engine according to claim 24, wherein said first communication passage and said second communication passage are formed of a common communication passage.

28. The two-cycle internal combustion engine according to claim 25, wherein said first communication passage and said second communication passage are formed of a common communication passage.

29. The two-cycle internal combustion engine according to claim 16, further comprising a second fuel injection device being positioned essentially orthogonal to said first fuel injection device.

30. The two-cycle internal combustion engine according to claim 16, further comprising a second fuel injection device being disposed in a direction of a rotational axis of said control valve.

* * * * *